US005306607A

United States Patent [19]

Begley et al.

[11] Patent Number: 5,306,607

[45] Date of Patent: Apr. 26, 1994

[54] PHOTOGRAPHIC MATERIAL AND PROCESS COMPRISING A PYRAZOLOTRIAZOLE MOIETY

[75] Inventors: William J. Begley, Webster; Teh-hsuan Chen; Frank D. Coms, both of Fairport; Donald Singleton, Hamlin, all of N.Y.

[73] Assignee: Eastman Kodak Company, Rochester, N.Y.

[21] Appl. No.: 971,379

[22] Filed: Nov. 4, 1992

[51] Int. Cl.[5] ..... G03C 7/32; G03C 7/34; G03C 7/36; G03C 7/38

[52] U.S. Cl. ..... 430/544; 430/548; 430/553; 430/557; 430/558 R; 430/955; 430/957; 430/555

[58] Field of Search ..... 430/543, 544, 548, 558 R, 430/957, 555, 955, 553, 557

[56] References Cited

U.S. PATENT DOCUMENTS

| | | | |
|---|---|---|---|
| 4,248,962 | 2/1981 | Lau | 430/382 |
| 4,338,393 | 7/1982 | Bailey et al. | 430/548 |
| 4,409,323 | 10/1983 | Sato et al. | 430/544 |
| 4,414,308 | 12/1983 | Hamada | 430/505 |
| 4,421,845 | 12/1983 | Uemura et al. | 430/544 |
| 4,594,313 | 6/1986 | Furutachi et al. | 430/381 |
| 4,861,701 | 8/1989 | Burns et al. | 430/543 |
| 4,927,743 | 5/1990 | Tamoto | 430/496 |
| 4,959,299 | 9/1990 | Sakanoue et al. | 430/544 |
| 5,021,322 | 6/1991 | Begley et al. | 430/544 |
| 5,055,385 | 10/1991 | Slusarek et al. | 430/955 |
| 5,071,735 | 12/1991 | Ichijima et al. | 430/505 |

FOREIGN PATENT DOCUMENTS 58-209737 12/1983 Japan .

*Primary Examiner*—Richard L. Schilling
*Attorney, Agent, or Firm*—Andrew Alexander

[57] ABSTRACT

A photographic element is disclosed comprising a support bearing at least one photographic silver halide emulsion layer and at least one photographic coupler comprising a pyrazolotriazole moiety (PT), the coupler having the formula wherein PT is a pyrazolotriazole moiety.

16 Claims, No Drawings

PHOTOGRAPHIC MATERIAL AND PROCESS COMPRISING A PYRAZOLOTRIAZOLE MOIETY

This invention relates to a photographic compound that releases a PUG (photographically useful group) such as a development inhibitor group upon oxidative coupling during photographic processing to enable increased activity, interlayer interimage and image acutance and to photographic materials and processes using such a compound. Activity herein means the amount of compound needed to have an effect on the causer ganuna described in the application.

Various ways are recognized in the photographic art for releasing a PUG from a compound, such as a coupler, in a photographic material and process. For example, U.S. Pat. No. 4,248,962 describes compounds that release a photographically useful group, such as a development inhibitor group. Other examples of compounds, particularly couplers, that are capable of release of development inhibitor groups are described in U.S. Pat. Nos. 4,409,323 and 4,861,701. These compounds, particularly couplers, are capable of releasing a development inhibitor group in a photographic material upon processing with a degree of control over timing and rate of release as well as the rate and distance of diffusion of the development inhibitor group in the photographic material.

In the art Japanese Patent 58(1983)-209737 discloses a photographic coupler having a pyrazolotriazole nucleus. However, such coupler does not provide for any flexibility of design and therefore finds only limited use in photographic elements. Other couplers using pyrazolotriazole and heterocyclic nuclei are disclosed in U.S. Pat. Nos. 4,594,313; 4,959,299; 4,927,743; 5,071,735; 4,414,308 and 4,421,845.

A need has existed for a compound, preferably a coupler, that provides greater flexibility in the release of a PUG, such as a development inhibitor group that provides increased acutance for the image produced upon processing the photographic material containing the compound. Moreover, such a need has existed with the added parameter that such a compound must not require significantly modifying the PUG or the carrier compound, such as the couplers, in such a way that would adversely affect the ultimate end use for which each is intended.

The present invention solves this problem by providing a photographic element comprising a support bearing at least one photographic silver halide emulsion layer and at least one photographic coupler comprising a pyrazolotriazole moiety (PT), said coupler or compound (A) having the formula

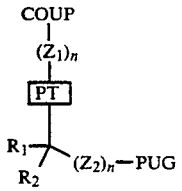

Formula (I)

wherein:

PT is a pyrazolotriazole moiety having the structure

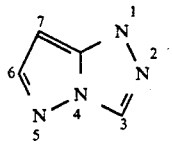

n is independently 0 or 1;

$Z_1$ is a releasing group having an oxygen, nitrogen or sulfur atom bonded to COUP;

$Z_2$ is a releasing group or timing group containing an oxygen or sulfur atom, said timing group bonded to —$C(R_1)(R_2)$— by said oxygen or sulfur;

$R_1$ and $R_2$ selected from hydrogen, substituted or unsubstituted aryl, substituted or unsubstituted alkyl, substituted or unsubstituted cycloalkyl, said aryl, cycloalkyl or alkyl having substituents selected from ester, chloro, bromo, carbamoyl, sulfamoyl, carbonamido, sulfonamide, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_1$ and $R_2$;

PUG is a photographically useful group; and

COUP is a photographic coupler moiety capable of forming a dye upon reaction with oxidized color developer.

In the present invention the PT moiety can function as a timing group or a releasing group. In one instance, for example, when n is 0 for $Z_2$ then the PT moiety can act as a timing group. Or, in another instance, when n is 1 for $Z_2$ the PT moiety can act either as a timing group or a releasing group. That is, both the PT moiety and $Z_2$ can act as timing groups when n is 1 for $Z_2$. Further, it will be appreciated that the PT moiety, $Z_1$ or $Z_2$ can individually function with or without time delay when released from COUP.

In a one embodiment the following group

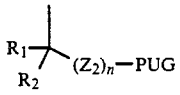

is located in the 3-position of the pyrazolotriazole moiety. That is, the coupler can have the formula

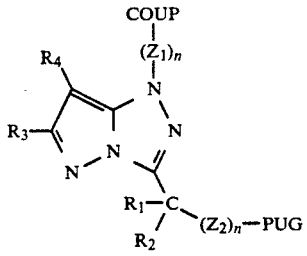

wherein:

$R_3$ is selected from hydrogen, substituted or unsubstituted aryl, substituted or unsubstituted alkyl, substituted or unsubstituted cycloalkyl wherein said $R_3$ or substituents of said aryl, cycloalkyl and alkyl are selected from ester, chloro, bromo, carbamoyl, sulfamoyl, carbonamido, sulfonamide, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_3$ and $R_4$;

$R_4$ is selected from hydrogen, substituted or unsubstituted aryl and substituted or unsubstituted alkyl and a group which hinders reaction of oxidized color developer with the pyrazolotriazole moiety;

$R_3$ and $R_4$ together may form a ring; and the other substituents are as defined above.

In a preferred embodiment of the invention $R_1$, $R_2$, $R_3$ and $R_4$ are selected from hydrogen, methyl, ethyl and phenyl.

In the present invention the releasing group, $Z_1$, may be selected from nitrogen or maybe selected from oxygen or sulfur containing groups consisting of *—O—C(O)—, *—O—C(S)—, *—O—$CH_2$—, *—S—C(O)—, *—S—C(S)— and *—S—$CH_2$— wherein the group is connected to COUP by the oxygen or sulfur atom denoted by *—O— or *—S—.

In the present invention $R_2$ can be a releasing group or timing group and may be selected from

*—O—C(O)—

*—O—C(S)—

*—O—$CH_2$—

*—S—C(O)—

*—S—$CH_2$—

*—S—C(S)—

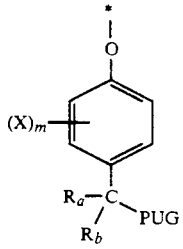

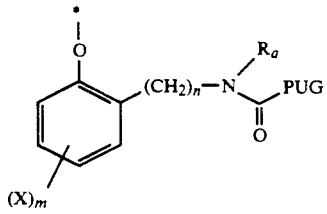

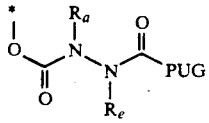

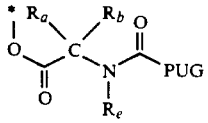

-continued

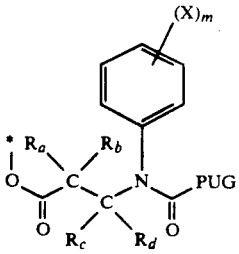

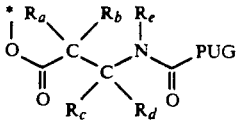

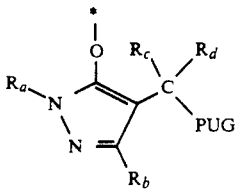

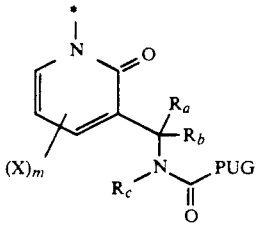

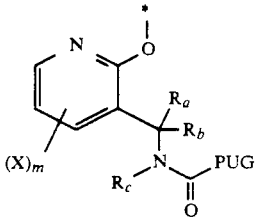

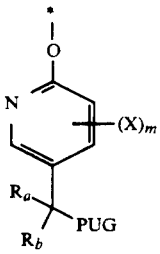

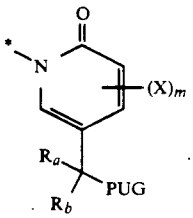

-continued

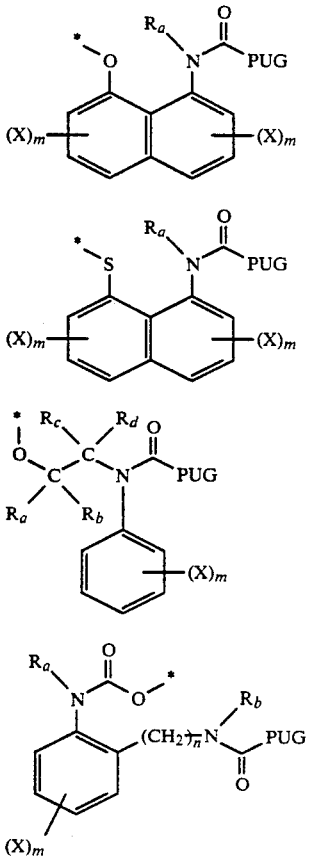

wherein said group is connected to —C($R_1$)($R_2$)— by the oxygen or sulfur atom denoted by *—O— or *—S—;

n is 0 or 1;

m is 0, 1, 2, or 3;

X is a substituent selected from hydrogen, substituted or unsubstituted aryl, substituted or unsubstituted alkyl, ester, chloro, bromo, carbamoyl, sulfamoyl, carbonamido, sulfonamide, keto, sulfo, nitro, hydroxyl, carboxyl, amino, substituted amino, alkyl, heterocyclic, alkoxy, aryloxy, arylthio, acylamino groups; and $R_1$, $R_b$, $R_c$, $R_d$ and $R_e$ are selected from hydrogen, substituted or unsubstituted aryl, and substituted or unsubstituted alkyl.

In a further embodiment of the present invention, a BALLAST group can be attached to the COUP, PT moiety, or to $Z_1$. When the BALLAST is attached to the PT moiety or to $Z_1$ this forms a washout dye upon reaction with oxidized color developer.

Any ballast group known in the photographic art can be useful on the COUP or coupling-off group. The ballast group herein means an organic group of such size and configuration as to confer on the coupler molecule sufficient bulk to render the coupler substantially nondiffusible from the layer in which it is coated in a photographic element prior to exposure and processing. Representative ballast groups include substituted or unsubstituted alkyl or aryl groups containing, for example, 8 to 40 carbon atoms. Other useful ballast groups include carbonamido, carbamoyl, sulfamoyl, sulfonamido, ester, sulfone, ether, thioether and amino groups containing 8 to 40 carbon atoms. Representative BALLAST groups are as follows:

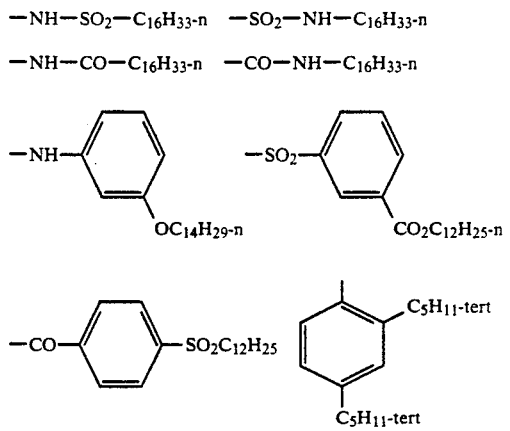

PUGs useful in the present invention can include development inhibitors, bleach accelerating fragments and dyes.

COUPs useful in the present invention can be selected from cyan, magenta, and yellow dye forming couplers.

When n is 0 for $Z_1$ a representative coupler or compound (A) of the present invention is as follows:

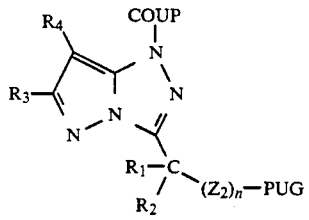

wherein:

n is 0 or 1;

$Z_2$ is a releasing group or timing group containing an oxygen or sulfur atom, said group bonded to —C($R_1$)($R_2$)— by said oxygen or sulfur;

$R_1$ and $R_2$ selected from hydrogen, substituted or unsubstituted aryl, substituted or unsubstituted alkyl, substituted or unsubstituted cycloalkyl, said aryl, cycloalkyl or alkyl having substituents selected from ester, chloro, bromo, carbamoyl, sulfamoyl, carbonamido, sulfonamide, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_1$ and $R_2$;

$R_3$ is selected from hydrogen, substituted or unsubstituted aryl, substituted or unsubstituted alkyl, substituted or unsubstituted cycloalkyl wherein said $R_3$ or substituents of said aryl, cycloalkyl and alkyl are selected from ester, chloro, bromo, carbamoyl, sulfamoyl, carbonamido, sulfonamide, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_3$ and $R_4$;

$R_4$ is selected from hydrogen, substituted or unsubstituted aryl and substituted or unsubstituted alkyl and a group which hinders reaction of oxidized color developer with the pyrazolotriazole moiety; PUG is a photographically useful group; and COUP is a photographic coupler capable of forming a dye upon reaction with oxidized color developer.

An example of compound (A) when $Z_1$ is represented by $—CH_2—W_1—$ has the following formula:

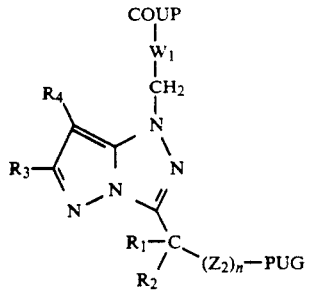

wherein:

n is 0 or 1;

$Z_2$ is a releasing group or timing group containing an oxygen or sulfur atom, said group bonded to $—C(R_1)(R_2)—$ by said oxygen or sulfur;

$R_1$ and $R_2$ selected from hydrogen, substituted or unsubstituted aryl, substituted or unsubstituted alkyl, substituted or unsubstituted cycloalkyl, said aryl, cycloalkyl or alkyl having substituents selected from ester, chloro, bromo, carbamoyl, sulfamoyl, carbonamido, sulfonamide, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_1$ and $R_2$;

$R_3$ is selected from hydrogen, substituted or unsubstituted aryl, substituted or unsubstituted alkyl, substituted or unsubstituted cycloalkyl wherein said $R_3$ or substituents of said aryl, cycloalkyl and alkyl are selected from ester, chloro, bromo, carbamoyl, sulfamoyl, carbonamido, sulfonamide, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_3$ and $R_4$;

$R_4$ is selected from hydrogen, substituted or unsubstituted aryl and substituted or unsubstituted alkyl and a group which hinders reaction of oxidized color developer with the pyrazolotriazole moiety;

$W_1$ is an oxygen, nitrogen or sulfur atom;

PUG is a photographically useful group; and

COUP is a photographic coupler capable of forming a dye upon reaction with oxidized color developer.

Another example of compound (A) when $Z_1$ is represented by $—W_1—C(=W_2)—$ has the following formula:

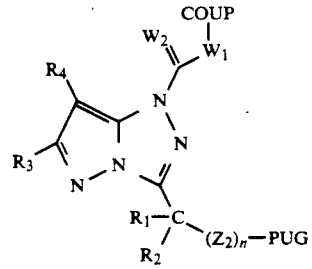

wherein the substituents are as defined above; $W_1$ and $W_2$ can be individually oxygen or sulfur.

Compounds (A) of the present invention have the following formulae when preferred COUPs are use:

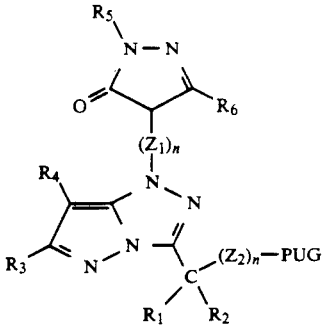

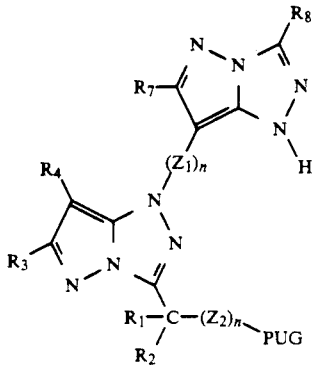

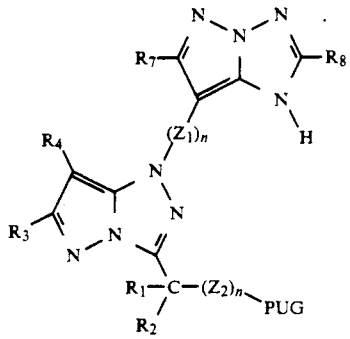

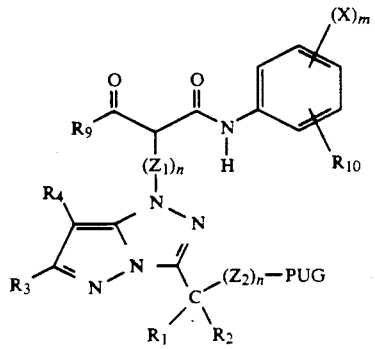

-continued

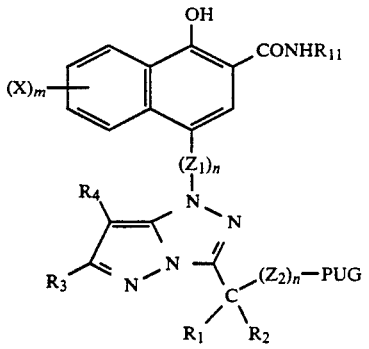

wherein:

n is independently 0 or 1;

$Z_1$ is a releasing group having an oxygen, nitrogen or sulfur atom bonded to COUP;

$Z_2$ is a releasing group or timing group containing an oxygen, or sulfur atom, said timing group bonded to —C($R_1$)($R_2$)— by said oxygen or sulfur;

$R_1$ and $R_2$ selected from hydrogen, substituted or unsubstituted aryl, substituted or unsubstituted alkyl, substituted or unsubstituted cycloalkyl, said aryl, cycloalkyl or alkyl having substituents selected from ester, chloro, bromo, carbamoyl, sulfamoyl, carbonamido, sulfonamide, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_1$ and $R_2$;

$R_3$ is selected from hydrogen, substituted or unsubstituted aryl, substituted or unsubstituted alkyl, substituted or unsubstituted cycloalkyl wherein said $R_3$ or substituents of said aryl, cycloalkyl and alkyl are selected from ester, chloro, bromo, carbamoyl, sulfamoyl, carbonamido, sulfonamide, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_3$ and $R_4$;

$R_4$ is selected from hydrogen, substituted or unsubstituted aryl and substituted or unsubstituted alkyl and a group which hinders reaction of oxidized color developer with the pyrazolotriazole moiety;

$R_5$, $R_6$, $R_7$, $R_8$, $R_9$, $R_{10}$ and $R_{11}$ are selected from substituted or unsubstituted alkyl, substituted or unsubstituted aryl, substituted or unsubstituted heterocycles, hydrogen, trifluoromethyl, carbamoyl, carbonamido, sulfamoyl, sulfonamido, cyano, substituted or unsubstituted amino, carboalkoxy, carboaryloxy, alkoxy, aryloxy, thioalkoxy, thioaryloxy, sulfone, and sulfoxide;

at least one of $R_5$, $R_6$, $R_7$, $R_8$, $R_9$, $R_{10}$ and $R_{11}$ is a BALLAST;

PUG is a photographically useful group;

m is 0, 1, 2, or 3; and

X is a substituent selected from hydrogen, substituted or unsubstituted aryl, substituted or unsubstituted alkyl, ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups.

Also preferred, are couplers having the formula:

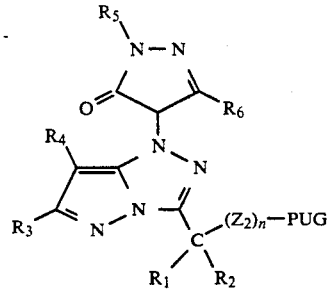

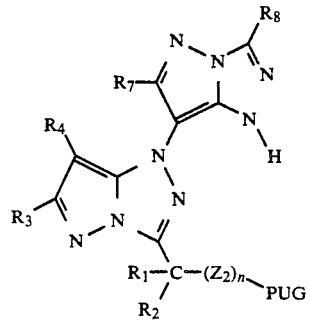

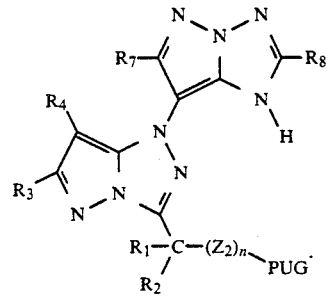

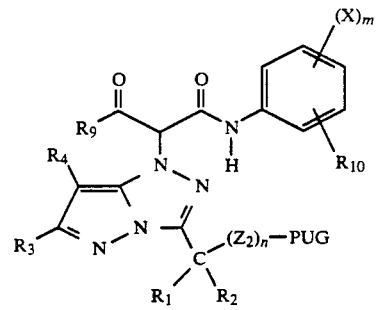

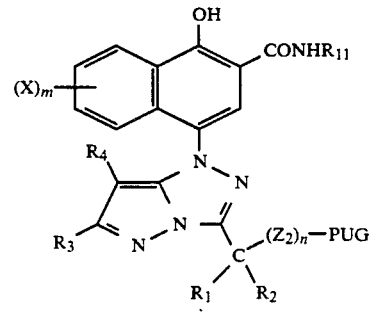

wherein:

n is 0 or 1;

$Z_2$ is a releasing group or timing group containing an oxygen or sulfur atom, said timing group bonded to —$C(R_1)(R_2)$— by said oxygen or sulfur;

$R_1$ and $R_2$ selected from hydrogen, substituted or unsubstituted aryl, substituted or unsubstituted alkyl, substituted or unsubstituted cycloalkyl, said aryl, cycloalkyl or alkyl having substituents selected from ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_1$ and $R_2$;

$R_3$ is selected from hydrogen, substituted or unsubstituted aryl, substituted or unsubstituted alkyl, substituted or unsubstituted cycloalkyl wherein said $R_3$ or substituents of said aryl, cycloalkyl and alkyl are selected from ester, chloro, bromo, carbamoyl, sulfamoyl, carbonamido, sulfonamide, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_3$ and $R_4$;

$R_4$ is selected from hydrogen, substituted or unsubstituted aryl and substituted or unsubstituted alkyl and a group which hinders reaction of oxidized color developer with the pyrazolotriazole moiety; $R_5$, $R_6$, $R_7$, $R_8$, $R_9$, $R_{10}$ and $R_{11}$ are selected from substituted or unsubstituted alkyl, substituted or unsubstituted aryl, substituted or unsubstituted heterocycles, hydrogen, trifluoromethyl, carbamoyl, carbonamido, sulfamoyl, sulfonamide, cyano, substituted or unsubstituted amino, carboalkoxy, carboaryloxy, alkoxy, aryloxy, thioalkoxy, thioaryloxy, sulfone, and sulfoxide; at least one of $R_5$, $R_6$, $R_7$, $R_8$, $R_9$, $R_{10}$ and $R_{11}$ is a BALLAST;

PUG is a photographically useful group;

m is 0, 1, 2, or 3; and

X is a substituent selected from hydrogen, substituted or unsubstituted aryl, substituted or unsubstituted alkyl, ester, chloro, bromo, carbamoyl, sulfamoyl, carbonamido, sulfonamide, keto, sulfo, nitro, hydroxyl, carboxyl, amino, substituted amino, alkyl, heterocyclic, alkoxy, aryloxy, arylthio, acylamino groups.

In the preferred COUPs noted above for compounds (A) of the present invention, $Z_1$ can be nitrogen or can be selected from oxygen or sulfur containing groups consisting of *—O—C(O)—, *—O—$CH_2$—, *—S—C(O)—, *—O—C(S)—, *—S—C(S)— and *—S—$CH_2$— wherein said group is connected to COUP by the oxygen or sulfur atom denoted by *—O— or *—S—.

In the preferred COUPs noted above for compounds (A) of the present invention in which n is 0 for the $Z_1$ group, $Z_2$ can be a timing or releasing group selected from

*—O—C(O)—

*—O—C(S)—

*—O—$CH_2$—

*—S—C(O)—

*—S—$CH_2$—

*—S—C(S)—

-continued

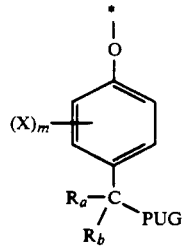

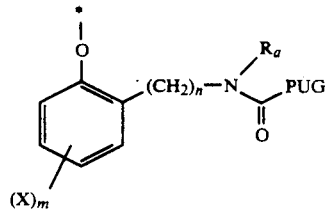

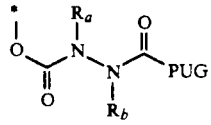

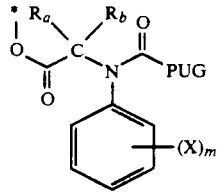

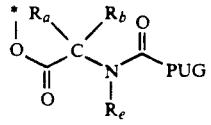

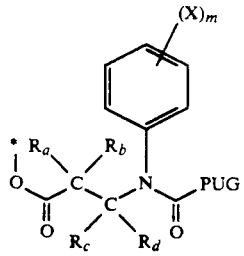

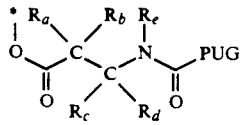

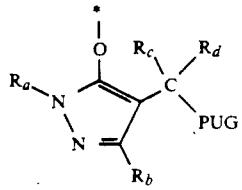

-continued

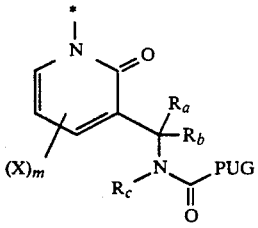

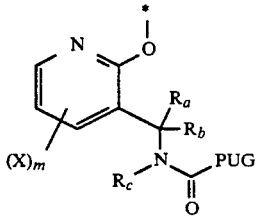

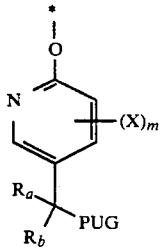

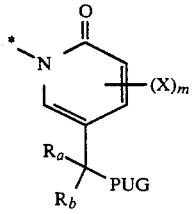

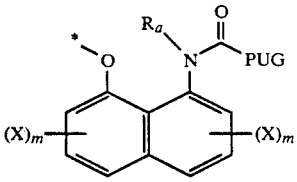

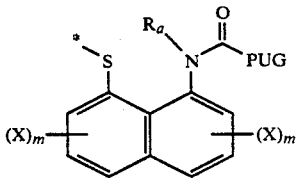

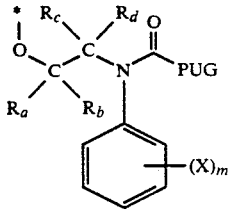

-continued

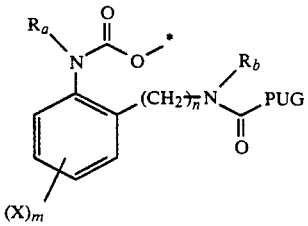

wherein said group is connected to —C($R_1$)($R_2$)— by said oxygen or sulfur atom denoted by *—O— or *—S—;

n is 0 or 1;

m is 0, 1, 2, or 3;

X is a substituent selected from hydrogen, substituted or unsubstituted aryl, substituted or unsubstituted alkyl, ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups; and $R_a$, $R_b$, $R_c$, $R_d$ and $R_e$ are selected from hydrogen, substituted or unsubstituted aryl, and substituted or unsubstituted alkyl.

A preferred compound (A) is a dye-forming coupler of the form

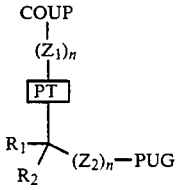

Formula (I)

in which COUP is a coupler moiety, such as a cyan, magenta or yellow dye-forming coupler moiety, and

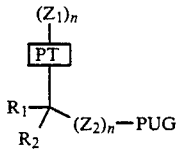

Formula (II)

is a coupling-off group.

When PUG is an inhibitor, a process of forming an image having the described increased acutance, and interlayer interimage comprises developing an exposed photographic silver halide element by means of a color developing agent in the presence of the described compound and particularly in the presence of the described coupler.

The reaction of compound (A), such as a development inhibitor releasing (DIR) coupler, bleaching accelerator releasing (BARC) coupler, dye releasing couplers, with oxidized color developing agent cleaves the bond between the coupling-off group,

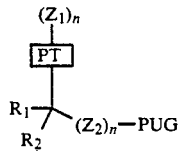

and the coupler moiety (COUP) of the compound (A). Tailoring of the structure of the coupling-off group, e.g. $Z_1$, $Z_2$ and PT, allows control of the desired characteristics of the resulting image in the photographic material.

As used herein the terms coupler and coupler compound refer to the entire compound, including the coupler moiety and the coupling-off group including the PUG. The term coupler moiety refers to that portion of the compound other than the coupling-off group The coupler moiety (COUP) can be any moiety that will react with oxidized color developing agent to cleave the bond between the coupling-off group and the coupler moiety. The coupler moiety herein includes coupler moieties employed in conventional color-forming couplers that yield colorless products on reaction with oxidized color developing agents as well as coupler moieties that yield colored products on reaction with oxidized color developing agents. Both types of coupler moieties are well known to those skilled in the photographic art.

The coupler moiety can be ballasted or unballasted. It can be monomeric, or it can be part of a dimeric, oligomeric or polymeric coupler, in which case more than one group containing PUG can be contained in the coupler, or it can form part of a bis compound in which the PUG forms part of a link between two coupler moieties.

The PUG can be any group that is typically made available in a photographic element in an imagewise fashion. The PUG can be a photographic reagent or a photographic dye. A photographic reagent herein is a moiety that upon release further reacts with components in the photographic element, such as a development inhibitor, a development accelerator, a bleach inhibitor, a bleach accelerator, a coupler (for example, a competing coupler, a dye-forming coupler, or a development inhibitor releasing coupler (DIR coupler), a dye precursor, a dye, a developing agent (for example, a competing developing agent, a dye-forming developing agent, or a silver halide developing agent), a silver complexing agent, a fixing agent, an image toner, a stabilizer, a hardener, a tanning agent, a fogging agent, an ultraviolet radiation absorber, an antifoggant, a nucleator, a chemical or spectral sensitizer or a desensitizer.

The PUG can be present in the coupling-off group as a preformed species or it can be present in a blocked form or as a precursor. The PUG can be for example a preformed development inhibitor or the development inhibiting function can be blocked by being the point of attachment to the carbonyl group bonded to PUG in the coupling-off group. Other examples are a preformed dye, a dye that is blocked to shift its absorption, and a leuco dye.

There follows a listing of patents and publications that describe representative COUP groups useful in the invention:

COUP's

A. Couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; 4,333,999 and "Farbkuppler-eine Literaturubersicht," published in Agfa mitteilungen, Band III, pp. 156–175 (1961).

Preferably such couplers are phenols and naphthols which form cyan dyes on reaction with oxidized color developing agent.

B. Couplers which form magenta dyes upon reaction with oxidized color developing agent are described in such representative patents and publications as: U.S. Pat. Nos. 2,600,788; 2,369,489; 2,343,703; 2,311,082; 3,152,896; 3,519,429; 3,062,653; 2,908,573 and "Farbkuppler-eine Literaturubersicht," published in Agfa Mitteilungen,Band III, pp. 126–156 (1961).

Preferably such magenta dye-forming couplers are pyrazolones or pyrazolotriazole couplers.

C. Couplers which form yellow dyes upon reaction with oxidized and color developing agent are described in such representative patents and publications as: U.S. Pat. Nos. 2,875,057; 2,407,210; 3,265,506; 2,298,443; 3,048,194; 3,447,928 and "Farbkuppler-eine Literaturubersicht," published in Agfa Mitteilungen, Band III, pp. 112–126 (1961).

Preferably such yellow dye-forming couplers are acylacetamides, such as benzoylacetamides and pivaloylacetamides.

D. Couplers which form colorless products upon reaction with oxidized color developing agent are described in such representative patents as: U.K. Patent No. 861,138; U.S. Pat. Nos. 3,632,345; 3,928,041; 3,958,993 and 3,961,959.

Representative examples of COUPs useful in the present invention are as follows:

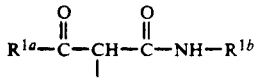

Formula (1A)

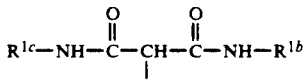

Formula (1B)

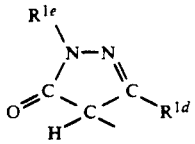

Formula (1C)

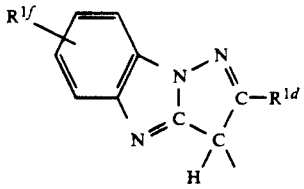

Formula (1D)

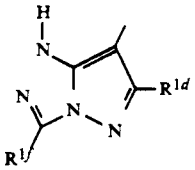

Formula (1E)

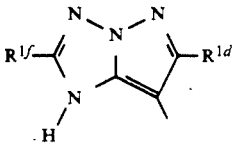

Formula (1F)

-continued

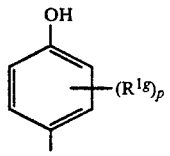

Formula (1G)

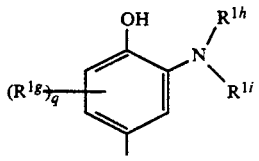

Formula (1H)

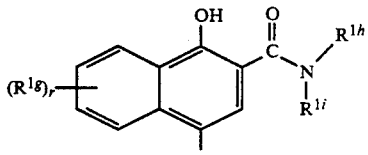

Formula (1I)

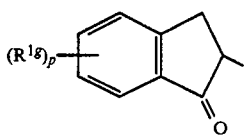

Formula (1J)

$R^{1j}$—CH—$R^{1k}$ (with a bond to the carbonyl group)

Formula (1K)

The effects of the present invention are obtained especially when, in formulae (I), COUP is a coupler radical represented by the formulae (1A), (1B), (1C), (1D), (1E), (1F), (1G), (1H), (1I), (1j) or (1K). These COUPs are preferred in that they increase the coupling speed.

A free bond from the coupling site in the above formulae indicates a position to which the coupling release group or coupling-off group as in Formula (II) is linked. In the above formulae, when $R^{1a}$, $R^{1b}$, $R^{1c}$, $R^{1d}$, $R^{1e}$, $R^{1f}$, $R^{1g}$, $R^{1h}$, $R^{1i}$, $R^{1j}$, or $R^{1k}$ contains an antidiffusing group, it is selected so that the total number of carbon atoms is from 8 to 32 and preferably from 10 to 22.

$R^{1a}$ to $R^{1k}$, p, q and r in formulae (1A) to (1K) are herein further explained.

$R^{1a}$ represents an aliphatic- or alicyclichydrocarbon group, an aryl group, an alkoxyl group, or a beterocyclic group, and $R^{1b}$ and $R^{1c}$ each represents an aryl group or a heterocyclic group.

The aliphatic- or alicyclic hydrocarbon group represented by $R^{1a}$ preferably has at most 22 carbon atoms, may be substituted or unsubstituted, and aliphatic hydrocarbon may be straight or branched. Preferred examples of the substituent for these groups represented by $R^{1a}$ are an alkoxy group, an aryloxy group, an amino group, an acylamino group, and a halogen atom. These substituents may be further substituted with at least one of these substituents repeatedly. Useful examples of the groups as $R^{1a}$ include an isopropyl group, an isobutyl group, a tertbutyl group, an isoamyl group, a tert-amyl group, a 1,1-dimethyl-butyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)isopropyl group, an α-(benzenesulfonamido)isopropyl group, and the like.

When $R^{1a}$, $R^{1b}$, or $R^{1c}$ is an aryl group (especially a phenyl group), the aryl group may be substituted. The aryl group (e.g., a phenyl group) may be substituted with groups having not more than 32 carbon atoms such as an alkyl group, an alkenyl group, an alkoxy group, an alkoxycarbonyl group, an alkoxycarbonylamino group, an aliphatic- or alicyclicamido group, an alkylsulfamoyl group, an alkylsulfonamido group, an alkylureido group, an aralkyl group and an alkyl-substituted succinimido group. This phenyl group in the aralkyl group may be further substituted with groups such as an aryloxy group, an aryloxycarbonyl group, an arylcarbamoyl group, an arylamido group, an arylsulfamoyl group, an arylsulfonamido group, and an arylureido group.

The phenyl group represented by $R^{1a}$, $R^{1b}$, or $R^{1c}$ may be substituted with an amino group which may be further substituted with a lower alkyl group having from 1 to 6 carbon atoms, a hydroxyl group, —COOM and —$SO_2M$ (M=H, an alkali metal atom, $NH_4$), a nitro group, a cyano group, a thiocyano group, or a halogen atom.

$R^{1a}$, $R^{1b}$, or $R^{1c}$ may represent substituents resulting from condensation of a phenyl group with other rings, such as a naphthyl group, a cniinolyl group, an isoquinolyl group, a chromanyl group, and a tetrahydronaphthyl group. These substituents may be further substituted repeatedly with at least one of above-described substituents for the phenyl group represented by $R^{1a}$, $R^{1b}$ or $R^{1c}$.

When $R^{1a}$ represents an alkoxy group, the alkyl moiety of the alkoxyl group can be a straight or branched alkyl group, an alkenyl group, a cycloalkyl group, or a cycloalkenyl group each having at most 32 carbon atoms, preferably at most 22 carbon atoms. These substituents may be substituted with groups such as halogen atom, an aryl group and an alkoxyl group to form a group having at most 32 carbon atoms.

When $R^{1a}$, $R^{1b}$, or $R^{1c}$ represents a heterocyclic ring, the heterocyclic group is linked to a carbon atom of the carbonyl group of the acyl group in α-acylacetamido or to a nitrogen atom of the amido group through one of the carbon atoms constituting the ring. Examples of such heterocyclic rings are thiophene, furan, pyran, pyrrole, pyrazole, pyridine, pyrazine, pyrimidine, pyridazine, indolizine, imidazole, thiazole, oxazole, triazine, thiadiazine and oxazine. These groups may further have a substituent or substituents in the ring thereof. Examples of the substituents include those defined for the aryl group represented by $R^{1a}$, $R^{1b}$ and $R^{1c}$.

In formula (1C), $R^{1e}$ is a group having at most 32 carbon atoms, preferably at most 22 carbon atoms, and it is a straight or branched alkyl group (e.g., a methyl group, an isopropyl group, a tert-butyl group, a hexyl group and a dodecyl group), an alkenyl group (e.g., an allyl group), a cycloalkyl group (e.g., a cyclopentyl group, a cyclohexyl group and a norbornyl group), an aralkyl group (e.g., a benzyl group and β-phenylethyl group), or a cycloalkenyl group (e.g., a cyclopentenyl group and a cyoloalkenyl group). These groups may be further substituted with groups such as a halogen atom, a nitro group, a cyano group, an aryl group, an alkoxyl group, an aryloxy group, —COOM (M=H, an alkali metal atom, $NH_4$) an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamide group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group, and a mercapto group.

Furthermore $R^{1e}$ may represent an aryl group (e.g., a phenyl group and an α- or β-naphthyl group). This aryl group may be substituted with at least one group. Examples of such substituents are an alkyl group, an alkenyl group, a cycloalkyl group, an aralkyl group, a cycloalkenyl group, a halogen atom, a nitro group, a cyano group, an aryl group, an alkoxyl group, an aryloxy group, —COOM (M=H, an alkali metal atom, $NH_4$), an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, alkylsulfonyl group, an arylthio group, an alkylthio group, an alkylamino group, a dialkylamino group, an anilino group, an N-alkylanilino group, an N-arylanilino group, an N-acylanilino group, a hydroxyl group, and a mercapto group. More preferred as $R^{1e}$ is a phenyl group which is substituted with at least one of the groups such as an alkyl group, an alkoxyl group, and a halogen atom in at least one ortho-position, because it decreases color formation due to light or heat of the coupler remaining in a film member.

Furthermore, $R^{1e}$ may represent a heterocyclic group (e.g., 5- or 6-membered heterocyclic rings and condensed heterocyclic groups containing at least one hetero atom i.e., a nitrogen atom, an oxygen atom or a sulfur atom such as a pyridyl group, a quinolyl group, a furyl group, a benzothiazolyl group, an oxazolyl group, an imidazolyl group, and a naphthooxazolyl group), a heterocyclic group substituted with a group as listed for the above aryl group represented by $R^{1e}$, an aliphatic, alicyclic or aromatic acyl group, an alkylsulfonyl group, an arysulfonyl group, an alkylcarbarmoyl group, an arylcarbamoyl group, an alkylthiocarbanoyl group or an arylthiocarbamoyl group.

$R^{1d}$ represents a hydrogen atom, and represents groups having at most 32 carbon atoms, preferably at most 22 carbon atoms, such as a straight or branched alkyl group, an alkenyl group, a cycloalkyl group, an aralkyl group, a cycloalkenyl group (these groups may have a substituent or substituents as listed for $R^{1e}$), an aryl group, a heterocyclic group (these groups may have a substituent or substituents as listed for $R^{1e}$ an alkoxycarbonyl group (e.g., a methoxycarbonyl group, an ethoxycarbonyl group, and a stearyloxycarbonyl group), an aryloxycarbonyl group (e.g., a phenoxycarbonyl group and a naphthoxycarbonyl group), an aralkyloxycarbonyl group (e.g., a benzyloxycarbonyl group), an alkoxy group (e.g., a methoxy group, an ethoxy group, and a heptadecyloxy group), an aryloxy group (e.g., a phenoxy group and a tolyloxy group), an alkylthio group (e.g., an ethylthio group and a dodecylthio group), an arylthio group (e.g., a phenylthio group and an α-naphthylthio group), —COOM(M=H alkali metal atom $NH_4$), an acylarnino group e.g., an acetylamino group and a 3-[(2,4-di-tert-amylphenoxy)acetamidolbenzamido group), a diacylamino group, an N-alkylacylamino group (e.g., an N-methylpropionamido group), an N-arylacylamino group (e.g., an N-phenylacetamido group), a ureido group, a substituted ureido group (e.g., an N-arylureido group, and an N-alkylureido group), a urethane group, a thiourethane group, an arylamino group (e.g., a phenylamino group, an N-methylanilino group, a diphenylamino group, an N-acetylanilino group, and a 2-chloro-5-tetradecaneamidoanilino group), an alkylamino group (e.g., an n-butylamino group, a methylamino group and a cyclohexylamino group), a cycloamino group (e.g., a piperidino group, and a pyrrolidino group), a heterocyclic amino group (e.g., a 4-pyridylamino group and a 2-benzooxazolidyl amino group), an alkylcarbonyl group (e.g., a methylcarbonyl group), an arylcarbonyl group (e.g., a phenylcarbonyl group), a sulfonamido group (e.g., an alkylsulfonamido group and an arylsulfonamido group), a carbamoyl group (e.g., an ethylcarbamoyl group, a dimethylcarbamoyl group an N-methyl-N-phenylcarbamoyl group and an N-phenylcarbamoyl group), a sulfamoyl group (e.g., an N-alkylsulfamoyl group, an N,N-dialkylsulfamoyl group, an N-arylsulfamoyl, an N-alkyl-N-arylsulfamoyl group, and an N,N-diarylsulfamoyl group), a cyano group, a hydroxyl group, a mercapto group, a halogen atom, or a sulfo group.

$R^{1f}$ represents a hydrogen atom, and represents groups having at most 32 carbon atoms, preferably at most 22 carbon atoms, such as a straight or branched alkyl group, an alkenyl group, a cycloalkyl group, an aralkyl group, or a cycloalkenyl group. These groups may be substituted with a group or groups as listed for $R^{1e}$.

$R^{1f}$ may be an aryl group or a heterocyclic group. These groups may be substituted with a group or groups as listed for $R^{1e}$.

$R^{1f}$ may be a cyano group, an alkoxyl group, an aryloxy group, a halogen atom, —COOM(M=H, an alkali metal atom, $NH_4$), an alkoxycarbonyl group, an aryloxycarbonyl group, an acyloxy group, a sulfo group, a sulfamoyl group, a carbarmoyl group, an acylamino group, a diacylamino group, a ureido group, a urethane group, a sulfonamido group, an arylsulfonyl group, an alkylsulfonyl group, an urylthio group, an alkylthio group, an alkylamino group, a dialkylamino group, an anilino group, an N-aryl-anilino group, an N-alkylanilino group, an N-acylanilino group, a hydroxyl group, or a mercapto group.

$R^{1g}$, $R^{1h}$, $R^{1i}$ each represents a group as is conventionally used in 4-equivalent phenol or α-naphthol couplers $R^{1g}$, $R^{1h}$ and $R^{1i}$ each may have at most 32 carbon atoms, and preferably at most 22 carbon atoms.

More specifically, $R^{1g}$ represents a hydrogen atom, a halogen atom, an alkoxycarbonylamino group, an aliphatic or alicyclic-hydrocarbon group, an N-arylureido group, an acylamino group, a group —$R^{11}$ or a group —S—$R^{11}$ (wherein $R^{11}$ is an aliphatic- or alicyclic-hydrocarbon radical). When two or more of the groups of $R^{1g}$ are contained in one molecule they may be different, and the aliphatic- and alicyclichydrocarbon radical may be substituted. In a case that these substituents contain an aryl group, the aryl group may be substituted with a group or groups as listed for $R^{1e}$.

$R^{1h}$ and $R^{1i}$ each represents a group selected from an aliphatic- or alicyclic-hydrocarbon radial, an aryl group, and a heterocyclic group, or one of $R^{1h}$ and $R^{1i}$ may be hydrogen atom. The above groups may be substituted. $R^{1h}$ and $R^{1i}$ may combine together to form a nitrogen-containing heterocyclic nucleus.

The aliphatic- and alicyclic-hydrocarbon radical may be saturated or unsaturated, and the aliphatic hydrocarbon may be straight or branched. Preferred examples are an alkyl group (e.g., a methyl group, an ethyl group, an isopropyl group, a butyl group, a tert-butyl group, an isobutyl group, a dodecyl group, an octadecyl group, a cyclobutyl group and a cyclohexyl group), and an alkenyl group (e.g., an alkyl group and an octenyl group). Typical examples of the aryl group are a phenyl group and a naphthyl group, and typical examples of the heterocyclic radical are a pyridinyl group, a quinolyl group, a thienyl group, a piperidyl group, and an imidazolyl group. Groups to be introduced in these aliphatic hydrocarbon radical, aryl group and heterocyclic radical include a halogen atom, a nitro group, a hydroxyl group, a carboxyl group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, and a morpholino group.

p is an integer of 1 to 4, q is an integer of 1 to 3, and r is an integer of 1 to 5.

$R^{1j}$ represents a group having at most 32 carbon atoms and preferably at most 22 carbon atoms. $R^{1j}$ represents an arylcarbonyl group, an alkanoyl group, an alkanecarbamoyl group, an alkoxycarbonyl group, or an aryloxycarbonyl group. These groups may be substituted with groups such as an alkoxyl group, an alkoxycarbonyl group, an acylamino group, an alkylsulfamoyl group, an alkylsulfonamido group, an alkylsuccinimide group, a halogen atom, a nitro group, a carboxyl group, a nitrile group, an alkyl group, and an aryl group.

$R^{1k}$ represents groups having at most 32 carbon atoms, and preferably at most 22 carbon atoms. $R^{1k}$ represents an arylcarbonyl group, an alkamoyl group, an arylcarbamoyl group, an alkanecarbamoyl group, an alkoxycarbonyl group, and aryloxycarbonyl group, and arylsulfonyl group, an arylsulfonyl group, an aryl group, or a 5- or 6-membered heterocyclic group (containing a hetero atom selected from a nitrogen atom, an oxygen atom, and a sulfur atom, e.g., a triazolyl group, an imidazolyl group, a phthalamido group, a succinamido group, a furyl group, a pyridyl group, and a benzotriazolyl group). These groups may be substituted with a group or groups as listed for $R^{1j}$.

The above described substituted groups in formulae 1A–1K may be further substituted repeatedly once, twice or more with a group selected from the same group of the substituents to form substituted groups having preferably at most 32 carbon atoms.

PUG groups that are useful in the present invention include, for example:

1. PUG's which form development inhibitors upon release

PUG's which form development inhibitors upon release are described in such representative patents as U.S. Pat. Nos. 3,227,554; 3,384,657; 3,615,506; 3,617,291; 3,733,201 and U.K. Pat. No. 1,450,479. Preferred development inhibitors are iodide and heterocyclic compounds such as mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, oxadiazoles, benzotriazoles and benzodiazoles. Structures of the preferred development inhibitor motieties are:

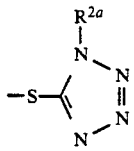

Formula (2A)

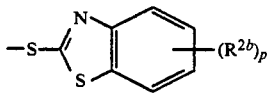

Formula (2B)

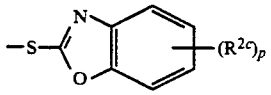

Formula (2C)

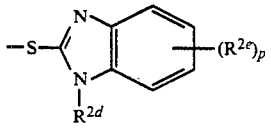

Formula (2D)

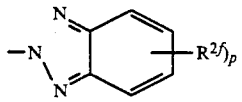

Formula (2E)

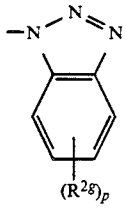

Formula (2F)

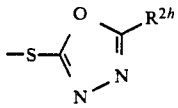

Formula (2G)

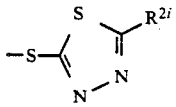

Formula (2H)

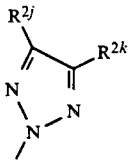

Formula (2I)

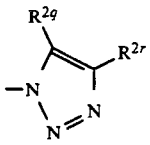

Formula (2J)

wherein:

$R^{2a}$, $R^{2d}$, $R^{2h}$, $R^{2i}$, $R^{2j}$, $R^{2k}$, $R^{2q}$ and $R^{2r}$ are individually hydrogen, substituted or unsubstituted alkyl, straight chained or branched, saturated or unsaturated, of 1 to 8 carbon atoms such as methyl, ethyl, propyl, butyl, 1-ethylpentyl, 2-ethoxyethyl; alkoxy or alkylthio, such as methoxy, ethoxy, propoxy, butoxy, octyloxy, methylthiol, ethylthiol, propylthiol, butylthiol, or octylthiol; alkyl esters such as $CO_2CH_3$, $CO_2C_2H_5$, $CO_2C_3H_7$, $CO_2C_4H_9$, $CH_2CO_2CH_3$, $CH_2CO_2C_2H_5$, $CH_2CO_2C_3H_7$, $CH_2CO_2C_4H_9$, $CH_2CH_2CO_2CH_3$, $CH_2CH_2CO_2C_2H_5$, $CH_2CH_2CO_2C_3H_7$, and $CH_2CH_2CO_2C_4H_9$; aryl or heterocyclic esters such as $CO_2R^{2s}$, $CH_2CO_2R^{2s}$, and $CH_2CH_2CO_2R^{2s}$ wherein $R^{2s}$ is substituted or unsubstituted aryl, or a substituted or unsubstituted heterocyclic group; substituted or unsubstituted benzyl, such as methoxybenzyl, chlorobenzyl, nitrobenzyl, or hydroxy, carboalkoxy, carboaryloxy, keto, sulfonyl, sulfenyl, sulfinyl, carbonamido, sulfonamide, carbamoyl or sulfamoyl substituted benzyl; substituted or unsubstituted aryl, such as phenyl, naphthyl, chlorophenyl, methoxyphenyl, hydroxyphenyl, nitrophenyl, or hydroxy, carboalkoxy, carboaryloxy, keto, sulfonyl, sulfenyl, sulfinyl carbonamido, sulfonamide, carbamoyl or sulfamoyl substituted phenyl. These substituents may be repeated more than once as substituents. $R^{2a}$, $R^{2d}$, $R^{2h}$, $R^{2i}$, $R^{2j}$, $R^{2k}$, $R^{2q}$ and $R^{2r}$ may also be a substituted or unsubstituted heterocyclic group selected from groups such as pyridine, pyrrole, furan, thiophene, pyrazole, thiazole, imidazole, 1,2,4-triazole, oxazole, thiadiazole, indole, benzothiophene, benzoimidazole, benzooxazole and the like wherein the substitutents are as selected from those mentioned previously.

$R^{2b}$, $R^{2c}$, $R^{2e}$, $R^{2f}$, and $R^{2g}$, are as described for $R^{2a}$, $R^{2d}$, $R^{2h}$, $R^{2i}$, $R^{2j}$, $R^{2k}$, $R^{2q}$ and $R^{2r}$; or, are individually one or more halogens such as chloro, fluoro or bromo and p is 0, 1, 2, 3 or 4.

2. PUGs which are, or form dyes upon release

Suitable dyes and dye precursors include azo, azomethine, azophenol, azonaphthol, azoaniline, azopyrazolone, indoaniline, indophenol, anthraquinone, triarylmethane, alizarin, nitro, quinoline, indigoid and phthalocyanine dyes or precursors of such dyes such as leuco dyes, tetrazolium salts or shifted dyes. These dyes can be metal complexed or metal complexable. Representative patents describing such dyes are U.S. Pat. Nos. 3,880,658; 3,931,144; 3,932,380; 3,932,381; 3,942,987, and 4,840,884. Preferred dyes and dye precursors are azo, azomethine, azophenol, azonaphthol, azoaniline, and indoaniline dyes and dye precursors. Structures of preferred dyes and dye precursors are:

Formula (3A)

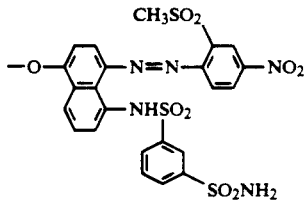

Formula (3B)

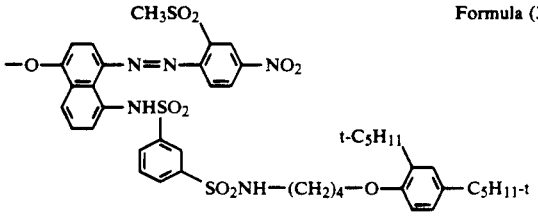

-continued

Formula (3C)

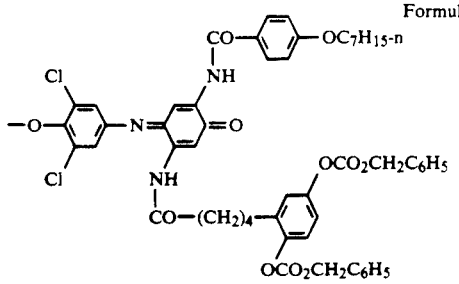

Formula (3D)

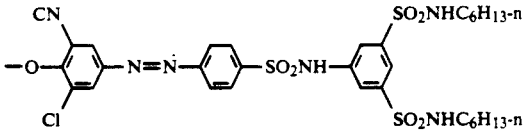

Formula (3E)

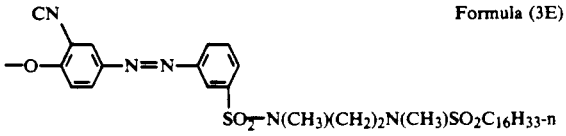

Formula (3F)

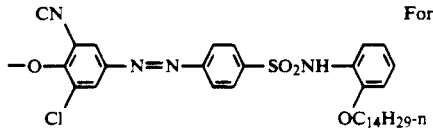

Formula (3G)

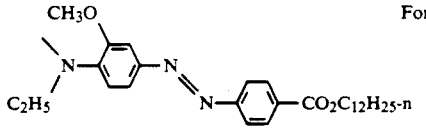

Formula (3H)

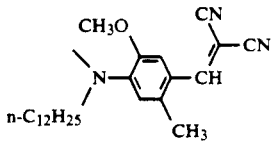

Formula (3I)

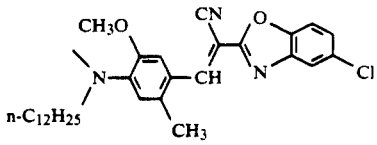

Preferred azo, azamethine and methine dyes are represented by the formulae in U.S. Pat. No. 4,840,884, col. 8, lines 1-70.

Dyes can be chosen from those described, for example, in J. Fabian and H. Hartmann, Light Absorption of Organic Colorants, published by Springer-Verlag Co., but are not limited thereto.

Preferred dyes are azo dyes having a radical represented by the following formula:

$$-X-Y-N=N-Z \qquad \text{Formula (3J)}$$

wherein X is a hetero atoms such as an oxygen atom, a nitrogen atom and a sulfur atom, Y is an atomic group containing at least one unsaturated bond having a conjugated relation with the azo group, and linked to X through an atom constituting the unsaturated bond, Z is an atomic group containing at least one unsaturated bond capable of conjugating with the azo group, and the number of carbon atoms contained in Y and Z is 10 or more.

In formula (3J), Y and Z are each preferably an aromatic group or an unsaturated heterocyclic group. As the aromatic group, a substituted or unsubstituted phenyl or naphthyl group is preferred. As the unsaturated heterocyclic group, a 4- to 7-membered heterocyclic group containing at least one hetero atom selected from a nitrogen atom, a sulfur atom and an oxygen atom is preferred, and it may be a benzene condensed ring. The heterocyclic group means groups having a ring structure such as pyrrole, thiophene, furan, imidazole, 1,2,4-triazole, oxazole, thiadiazole, pyridine, indole, benzothiophene, benzoimidazole, or benzooxazole.

Y may be substituted with other groups as well as X and the azo groups. Examples of such other groups include an aliphatic or alicyclic hydrocarbon group, an aryl group, an acyl group, an alkoxycarbonyl group, an aryloxycarbonyl group, an acylamino group, an alkylthio, an arylthio group, a heterocyclic group, a sulfonyl group, a halogen atom, a nitro group, a nitroso group, a cyano group, —COOM (M=H, an alkali metal atom or $NH_4$), a hydroxyl group, a sulfonamide group, an alkoxyl group, an aryloxy group, and an acyloxy group. In addition, a carbamoyl group, an amino group, a ureido group, a sulfamoyl group, a carbamoylsulfonyl group and a hydrazino group are included. These groups may be further substituted with a group such as those disclosed above repeatedly, for example once or twice.

In a case that Z is a substituted aryl group or a substituted unsaturated heterocyclic group, as substituents, groups as listed for Y can be used in the same manner as for Y.

When Y and Z contain an aliphatic or alicyclic hydrocarbon moiety as a substituent, any of substituted or unsubstituted, saturated or unsaturated or straight or branched groups having from 1 to 32, preferably from 1 to 20 carbon atoms, in the case of aliphatic hydrocarbon moiety, and having from 5 to 32, preferably from 5 to 20 carbon atoms in the case of alicyclic hydrocarbon moiety can be used. When substitution is carried out repeatedly, the uppermost number of carbon atom of the thus obtained substituent is preferably 32.

When Y and Z contain an aryl moiety as a substituent, the number of carbon atoms of the moiety is generally from 6 to 10, and preferably it is a substituted or unsubstituted phenyl group. In the present invention groups in formula shown hereinabove and hereinafter are defined as follows:

An acyl group, a carbamoyl group, an amino group, a ureido group, a sulfamoyl group, a carbamoylsulfonyl group, an urethane group, a sulfonamido group, a hydrazino group, and the like represents unsubstituted groups thereof and substituted groups thereof which are substituted with an aliphatic hydrocarbon group, an alicyclic hydrocarbon group or an aryl group to form mono-, di-, or tri-substituted groups; an acylamino group, a sulfonyl group, a sulfonamide group, an acyloxy group and the like each is aliphatic alicyclic, and aromatic group.

Preferred examples of this group represented by formula (3J) are shown in for example U.S. Pat. Nos. 4,857,447, column 6, lines 35–70; and 4,424,156.

3. PUG's which are couplers

Couplers released can be nondiffusible color-forming couplers, non-color forming couplers or diffusible competing couplers. Representative patents and publications describing competing couplers are: "On the Chemistry of White Couplers," by W. Puschel, Agfa-Gevaert AG Mitteilungen and der Forschungs-Laboratorium der Agfa-Gevaert AG, Springer Verlag, 1954, pp. 352–367; U.S. Pat. Nos. 2,998,314; 2,808,329; 2,689,793; 2,742,832; German Pat. No. 1,168,769 and British Pat. No. 907,274. Structures of preferred competing couplers are:

Formula (4A)

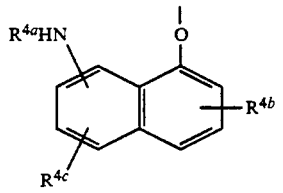

where $R^{4a}$ is hydrogen or alkylcarbonyl, such as acetyl, and $R^{4b}$ and $R^{4c}$ are individually hydrogen or a solubilizing group, such as sulfo, aminosulfonyl, and carboxy Formula (4B)

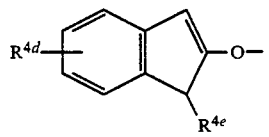

where $R^{4d}$ is as defined above and $R^{4e}$ is halogen, aryloxy, arylthio, or a development inhibitor, such as a mercaptotetrazole, such as phenylmercaptotetrazole or ethylmercaptotetrazole.

4. PUG's which form developing agents

Developing agents released can be color developing agents, black-and-white developing agents or cross-oxidizing developing agents. The include aminophenols, phenylenediamines, hydroquinones and pyrazolidones. Representative patents are U.S. Pat. Nos. 2,193,015; 2,108,243; 2,592,364; 3,656,950; 3,658,525; 2,751,297; 2,289,367; 2,772,282; 2,743,279; 2,753,256 and 2,304,953.

Structures of preferred developing agents are:

Formula (5A)

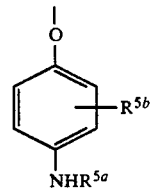

where $R^{5a}$ is hydrogen or alkyl of 1 to 4 carbon atoms and $R^{5b}$ is hydrogen or one or more halogen such as chloro or bromo; or alkyl of 1 to 4 carbon atoms such as methyl, ethyl or butyl groups.

Formula (5B)

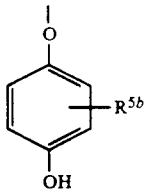

where $R^{5b}$ is as defined above.

Formula (5C)

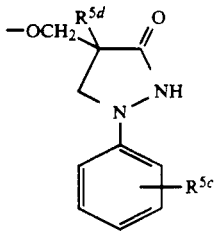

Formula (5D)

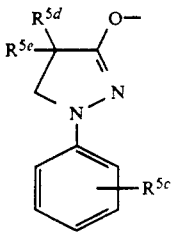

Formula (5E)

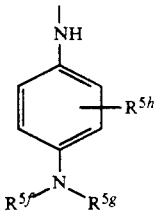

Formula (5F)

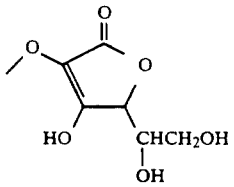

where $R^{5c}$ is hydrogen or alkyl of 1 to 4 carbon atoms and $R^{5d}$, $R^{5e}$, $R^{5f}$, $R^{5g}$, and $R^{5h}$ are individually hydrogen, alkyl of 1 to 4 carbon atoms such as methyl or ethyl; hydroxyalkyl of 1 to 4 carbon atoms such as hydroxymethyl or hydroxyethyl or sulfoalkyl containing 1 to 4 carbon atoms.

5. PUG's which are bleach inhibitors

Representative patents are U.S. Pat. Nos. 3,705,801; 3,715,208; and German OLS No. 2,405,279. Structures of preferred bleach inhibitors are:

Formula (6A)

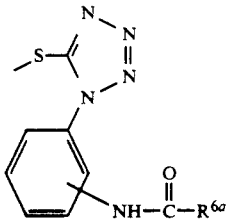

Formula (6B)

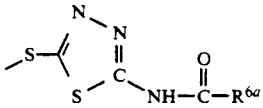

Formula (6C)

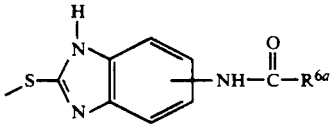

Formula (6D)

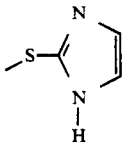

where $R^{6a}$ is alkyl such as alkyl of 6 to 20 carbon atoms.

6. PUG's which are bleach accelerators

Formula (7A)

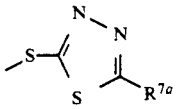

Formula (7B)

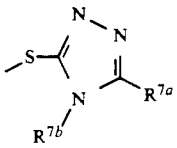

Formula (7C)

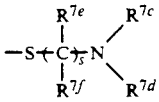

Formula (7D)

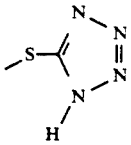

Formula (7E)

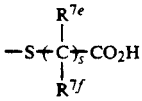

wherein $R^{7a}$ is hydrogen, alkyl, such as ethyl and butyl, alkoxy, such as ethoxy and butoxy, or alkylthio, such as ethylthio and butylthio, for example containing 1 to 6 carbon atoms, and which may be unsubstituted or substituted; $R^{7b}$ is hydrogen, substituted or unsubstituted alkyl, or substituted or unsubstituted aryl, such as phenyl; $R^{7c}$, $R^{7d}$, $R^{7e}$ and $R^{7f}$ are individually hydrogen, substituted or unsubstituted alkyl, or substituted or unsubstituted aryl, such as straight chained or branched alkyl containing 1 to 6 carbon atoms, for example methyl, ethyl and butyl; s is 1 to 6; $R^{7c}$ and $R^{7d}$, or $R^{7e}$ and $R^{7f}$ together may form a 5-, 6-, or 7-membered ring.

Other PUGs representative of bleach accelerators, can be found in for example U.S. Pat. Nos. 4,912,024; 5,063,145, columns 21-22, lines 1-70; and EP Patent No 0,193,389.

7. PUGs which are electron transfer agents (ETAS)

ETAs useful in the present invention are 1-aryl-3-pyrazolidinone derivatives which, once released, become active electron transfer agents capable of accelerating development under processing conditions used to obtain the desired dye image.

The electron transfer agent pyrazolidinone moieties which have been found to be useful in providing development acceleration function are derived from compounds generally of the type described in U.S. Pat. Nos. 4,209,580;, 4,463,081; 4,471,045; and 4,481,287 and in published Japanese patent application No. 62-123,172. Such compounds comprise 3-pyrazolidinone structure having an unsubstituted or substituted aryl group in the 1-position. Preferably these compounds have one or more alkyl groups in the 4-or 5-positions of the pyrazolidinone ring.

Preferred electron transfer agents suitable for use in this invention are represented in formulae (8A) and (SB):

Formula (8A)

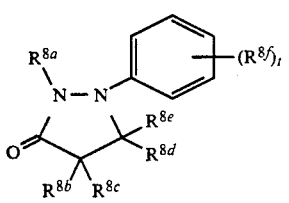

Formula (8B)

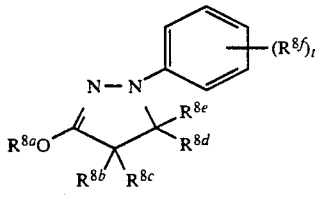

wherein:

$R^{8a}$ is hydrogen;

$R^{8b}$ and $R^{8c}$ each independently represents hydrogen, substituted or unsubstituted alkyl having from 1 to about 8 carbon atoms (such as hydroxyalkyl), carbamoyl, or substituted or unsubstituted aryl having from 6,to about 10 carbon atoms;

$R^{8d}$ and $R^{8e}$ each independently represents hydrogen, substituted or unsubstituted alkyl having from I to about 8 carbon atoms or substituted or unsubstituted aryl having from 6 to about 10 carbon atoms;

$R^{8f}$, which may be present in the ortho, meta or para positions of the benzene ring, represents halogen, substituted or unsubstituted alkyl living from 1 to about 8 carbon atoms, or substituted or unsubstituted alkoxy having from 1 to about 8 carbon atoms, or sulfonamide, and when m is greater than 1, the $R^{8f}$ substituents can be the same or different or can be taken together to form a carbocyclic or a heterocyclic ring, for example a benzene or an alkylenedioxy ring; and t is 0 or I to 3.

When $R^{8b}$ and $R^{8c}$ groups are alkyl it is preferred that they comprise from 1 to 3 carbon atoms. When $R^{8b}$ and $R^{8c}$ represent aryl, they are preferably phenyl.

$R^{8d}$ and $R^{8e}$ are preferably hydrogen.

When $R^{8f}$ represents sulfonamide, it may be, for example, methanesulfonamido, ethanesulfonamido or toluenesulfonamido.

8. PUGS which are development inhibiting reflex releasers (T)IRRs)

DIRRs useful in the present invention include hydroquinone, catechol, pyrogallol, 1,4-naphthohydroquinone, 1,2-naphthoquinone, sulfonamidophenol, sulfonamidonaphthol and hydrazide derivatives which, once released, become active inhibitor redox releasing agents which are then capable of releasing a development inhibitor upon reaction with a nucleophile such as hydroxide ion under processing conditions used to obtain the desired dye image. Such redox releasers are represented by formula (II) in U.S. Pat. No. 4,985,336; col. 3, lines 10 to 25 and fomulae (III) and (IV) col.14, line 54 to col. 17, line 11. Other redox releasers can be found in European Patent Application No. 0,285,176. Preferred redox releasers are as follows:

Formula (9A)

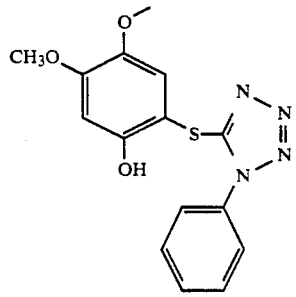

Formula (9B)

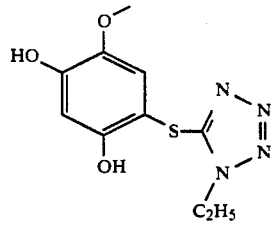

Formula (9C)

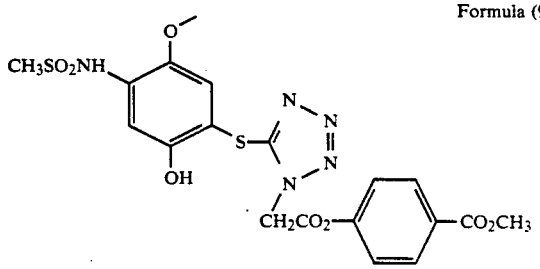

-continued

Formula (9D)

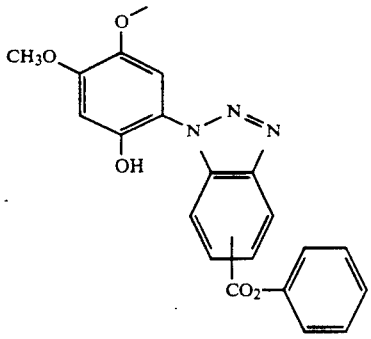

Formula (9E)

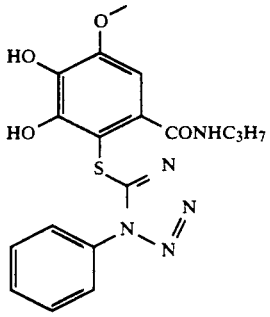

Couplers containing other preferred redox releasers can be found in for example, U.S. Pat. No. 4,985,336; cols. 17 to 62.

Formula (9F) represents a 5-, 6-, or 7-membered nitrogen-containing unsaturated heterocyclic group which has 2 to 6 carbon atoms, which is connected to the COUP, releasing group or timing group, through the nitrogen atom and which has a sulfonamido group and a development inhibitor group or a precursor thereof, on the ring carbon atoms. Z represents an atomic group necessary to form a 5-, 6-, or 7-membered nitrogen-containing unsaturated heterocyclic ring containing 2 to 6 carbon atoms together with the nitrogen atom; DI represents a development inhibitor group; and R represents a substituent; and DI is connected to a carbon atom of the heterocyclic ring represented by z through a hetero atom included therein, and the sulfonamido group is connected to a carbon atom of the heterocyclic ring represented by Z, provided that the nitrogen atom at which COUP, releasing group or timing group (e.g. $(Z_2)_n$ of formula (I)) is connected and the nitrogen atom in the sulfonamido group are positioned so as to satisfy the Kendall-Pelz rule as described, for example in T. H. James ed., "The Theory Of The Photographic Process", 4th ed., pp. 298-325, Macmillan Publishing Co., Inc., New York, 1977.

Formula (9F)

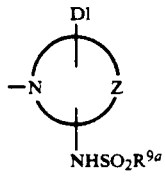

The group represented by formula (8F) is a group capable of being oxidized by the oxidation product of a developing agent. More specifically, the sulfonamido group thereon is oxidized to a sulfonylimino group whereby a development inhibitor is cleaved for the first time.

Specific examples of development inhibiting redox releasers of formula (9F) are as follows:

Formula (9G)

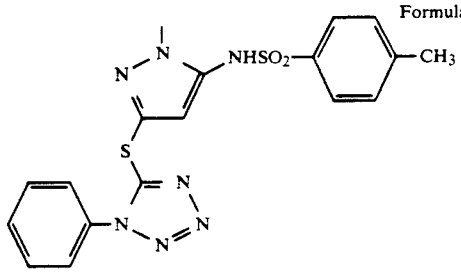

Formula (9H)

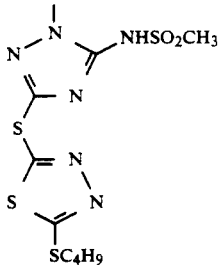

Other examples of development inhibiting redox releasers of formula (9F) can be found in the couplers represented in for example European Patent Application 0,362,870; page 13, line 25 to page 29, line 20.

The photographic couplers of the invention can be incorporated in photographic elements by means and processes known in the photographic art. In a photographic element prior to exposure and processing the photographic coupler should be of such size and configuration that it will not diffuse through the photographic layers.

Photographic elements of this invention can be processed by conventional techniques in which color forming couplers and color developing agents are incorporated in separate processing solutions or compositions or in the element.

Photographic elements in which the compounds of this invention are incorporated can be a simple element comprising a support and a single silver halide emulsion layer or they can be multilayer, multicolor elements. The compounds of this invention can be incorporated in at least one of the silver halide emulsion layers and/or in at least one other layer, such as an adjacent layer, where they will come into reactive association with oxidized color developing agent which has developed silver halide in the emulsion layer. The silver halide emulsion layer can contain or have associated with it, other photographic coupler compounds, such as dye-forming couplers, colored masking couplers, and/or competing couplers. These other photographic couplers can form dyes of the same or different color and hue as the photographic couplers of this invention. Additionally, the silver halide emulsion layers and other layers of the photographic element can contain addenda conventionally contained in such layers.

A typical multilayer, multicolor photographic element can comprise a support having thereon a redsensitive silver halide emulsion unit having associated therewith a cyan dye image-providing material, a greensensitive silver halide emulsion unit having associated therewith a magenta dye image-providing material and a blue-sensitive silver halide emulsion unit having associated therewith a yellow dye image-providing material, at least one of the silver halide emulsion units having associated therewith a photographic coupler of the invention. Each silver halide emulsion unit can be composed of one or more layers and the various units and layers can be arranged in different locations with respect to one another.

The couplers of this invention can be incorporated in or associated with one or more layers or units of the photographic element. For example, a layer or unit affected by PUG can be controlled by incorporating in appropriate locations in the element a scavenger layer which will confine the action of PUG to the desired layer or unit. At least one of the layers of the photographic element can be, for example, a mordant layer or a barrier layer.

The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. The emulsions can be negative-working or direct-positive emulsions. They can form latent images predominantly on the surface of the silver halide grains or predominantly on the interior of the silver halide grains. They can be chemically and spectrally sensitized. The emulsions typically will be gelatin emulsions although other hydrophilic colloids are useful. Tabular grain light sensitive silver halides are particularly useful such as described in *Research Disclosure*, January, 1983, Item No. 22534 and U.S. Pat. No. 4,434,226.

The support can be any support used with photographic elements. Typical supports include cellulose nitrate film, cellulose acetate film, polyvinylacetal film, polyethylene terephthalate film, polycarbonate film and related films or resinous materials as well as glass, paper, metal and the like. Typically, a flexible support is employed, such as a polymeric film or paper support. Paper supports can be acetylated or coated with baryta and/or an $\alpha$-olefin polymer, particularly a polymer of an $\alpha$-olefin containing 2 to 10 carbon atoms such as polyethylene, polypropylene, ethylene-butene copolymers and the like.

The compound (A), particularly photographic couplers as described, can be used in photographic elements in the same way as photographic couplers which release PUGs have previously been used in photographic elements. However, because of the improved ability to control the release of the PUG, the couplers permit enhanced effects or more selective effects. In addition, the couplers can be employed in applications where conventional couplers have previously been employed and a separate component was employed to provide a PUG.

Depending upon the nature of the particular PUG, the couplers can be incorporated in a photographic element for different purposes and in different locations.

When the PUG released from the coupler is a development inhibitor, the coupler can be employed in a photographic element like couplers which release development inhibitors have been used in the photographic art. Couplers of this invention which release a development inhibitor can be contained in, or in reactive association with, one or more of the silver halide emulsion units in a color photographic element. If the silver halide emulsion unit is composed of more than one layer, one or more of such layers can contain the coupler of this invention. The layers can contain other photographic couplers conventionally used in the art. The coupling reaction using couplers of this invention can form dyes of the same color as the color forming coupler(s) in the layer or unit, it can form a dye of a different color, or it can result in a colorless or neutral reaction product. The range of operation between layers of the development inhibitor released from the coupler of this invention can be controlled by the use of scavenger layers, such as a layer of fine grain silver halide emulsion. Scavenger layers can be in various locations in an element containing couplers of this invention. They can be located between layers, between the layers and the support, or over all of the layers.

Couplers of this invention which release development inhibitors can enhance the effects heretofore obtained with DIR couplers since they can release a development inhibitor at a distance from the point at which oxidized color developing agent reacted with the coupler, in which case they can provide, for example, enhanced interlayer interimage effects.

Photographic couplers as described which release bleach inhibitors or bleach accelerators can be employed in the ways described in the photographic art to inhibit the bleaching of silver or accelerated bleaching in areas of a photographic element.

Photographic couplers as described which release a dye or dye precursor can be used in processes where the dye is allowed to diffuse to an integral or separate receiving layer to form a desired image. Alternatively, the dye can be retained in the location where it is released to augment the density of the dye formed from the coupler from which it is released or to modify or correct the hue of that dye or another dye. In another embodiment, the dye can be completely removed from the element and the dye which was not released from the coupler can be retained in the element as a color correcting mask.

Couplers as described can be employed to release another coupler and the PUG. If the released coupler is a dye-forming coupler it can react with oxidized developing agent in the same or an adjacent layer to form a dye of the same or a different color or hue as that obtained from the primary coupler. If the released coupler is a competing coupler it can react with oxidized color developing agent in the same or an adjacent layer to reduce dye density.

Photographic couplers as described in which the PUG is a developing agent can be used to release a developing agent which will compete with the color forming developing agent, and thus reduce dye density. Alternatively, the couplers can provide, in an imagewise manner, a developing agent which because of such considerations as activity would not desirably be introduced into the element in a uniform fashion.

In the following discussion of suitable materials for use in the emulsions and elements of this invention, reference will be made to *Research Disclosure*, December, 1978, Item 17643, published by Industrial Opportunities Ltd., Homewell Havant, Hampshire, PO9 1EF, U.K., the disclosures of which are incorporated herein by reference. This publication will be identified hereafter by the term "Research Disclosure".

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. oxidized color developing agent in turn reacts with the coupler to yield a dye.

Preferred color developing agents useful in the invention are p-phenylene diamines. Especially preferred are 4-amino-N,N-diethylaniline hydrochloride; 4-amino-3-methyl-N,N-diethylaniline hydrochloride; 4-amino-3-methyl-N-ethyl-N-β-(methanesulfonamido)ethylaniline sulfate hydrate; 4-amino-3-methyl-N-ethyl-N-β-hydroxyethylaniline sulfate; 4-amino-3-β-(methanesulfonamido)ethyl-N,N-diethylaniline hydrochloride; and 4-amino-N-ethyl-N-(2-methoxyethyl)-m-toluidine di-p-toluenesulfonic acid.

The described photographic materials and processes can be used with photographic silver halide emulsions and addenda known to be useful in the photographic art, as described in, for example, *Research Disclosure*, December, 1989, Item No. 308,119, the disclosures of which are incorporated herein by reference.

With negative working silver halide. The processing step described above gives a negative image. To obtain a positive (or reversal) image, this step can be preceded by development with a non-chromogenic developing agent to develop exposed silver halide, but not form a dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

Compounds as described can be prepared by reactions and methods known in the organic compound synthesis art. Typically, the couplers, as described, are prepared by first attaching the coupling-off group to the coupling position of the coupler moiety (COUP) without the PUG present. Then the product is reacted with an appropriate derivative of the PUG to form the coupler. Alternatively, the PUG may be attached first to the coupling-off group, and then the coupling-off-PUG group attached to the COUP. Suitable synthesizing steps are set forth in U.S. Pat. Nos. 5,026,628; 4,857,440 and 5,021,322 incorporated herein by reference.

The following examples further illustrate the invention.

EXAMPLES I-1 - I-4

Photographic elements were prepared by coating the following layers on a cellulose ester film support (amounts of each component are indicated in mg/m$^2$):

| | |
|---|---|
| Emulsion layer 1: | Gelatin-2420; red sensitized silver bromoiodide (as Ag)-1615; yellow image coupler Y-1, dispersed in dibutylphthalate; (RECEIVER LAYER). |
| Interlayer: | Gelatin-860; didodecylhydro-quinone-113. |
| Emulsion layer 2: | Gelatin-2690; green sensitized silver bromoiodide (as Ag)-1615; magenta image coupler M-1, dispersed in tritolylphosphate; DIR compound of Table 1 dispersed in N,N-diethyl-dodecanamide and coated at a level sufficient to provide a contrast of 0.5 (half) of the original contrast after stepwise green light exposure and processing; (CAUSER LAYER). |
| Protective Overcoat | Gelatin-5380; bisvinylsulfonylmethyl ether at 2% total gelatin. |

Structures of the image couplers are as follows:

Magenta Image Coupler, M-1:

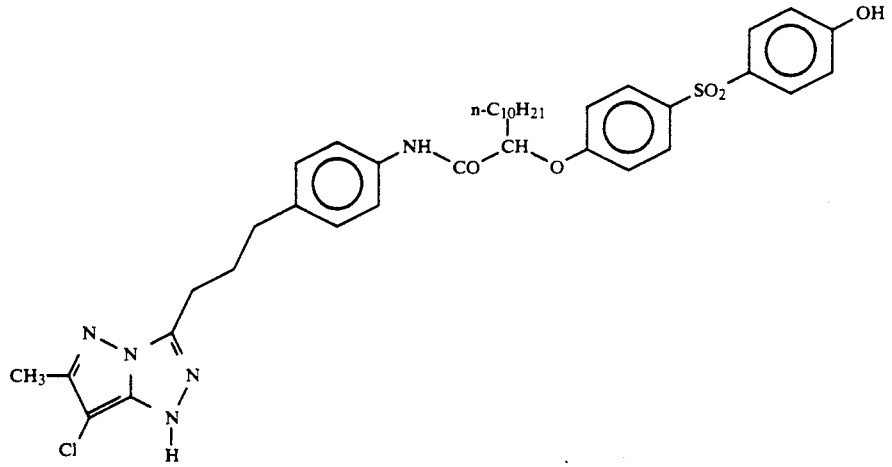

Yellow Image Coupler, Y-1:

-continued

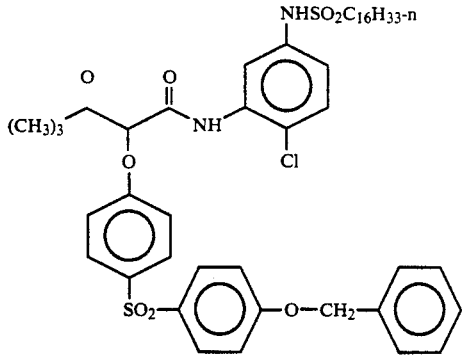

Strips of each element were exposed to green light through a graduated density step tablet, or through a 35% modulation fringe chart for sharpness measurements, and then developed 3.25 minutes at 38° C. in the following color developer, stopped, washed, bleached, fixed, washed and dried.

| Color Developer: | |
|---|---|
| Distilled water | 800 mL |
| Sodium Metabisulfite | 2.78 g |
| Sodium Sulfite, anhydrous | 0.38 g |
| CD-4 (color developer)* | 4.52 g |
| Potassium Carbonate, anhyd. | 34.3 g |
| Potassium Bicarbonate | 2.32 g |
| Sodium Bromide | 1.31 g |
| Potassium Iodide | 1.20 mg |
| Hydroxylamine Sulfate (HAS) | 2.41 g |
| Diethylenetriaminepentacetic acid, pentasodium salt (40% Soln.) | 8.43 g |
| Distilled water | to 1 L |
| Adjust pH to 10.0. | |

*CD-4 is 4-amino-3-methyl-N-ethyl-N-beta-hydroxy-ethylaniline sulfate.

Processed images were read with green light to determine the contrast and AMT acutance. From plots of AMT acutance vs. the logarithm of the contrast for variations in the coated level of each development inhibitor releasing (DIR) compound, the acutance was determined at a contrast of 0.5 compared to its original contrast without the presence of the DIR compound. These acutance values are recorded in Table 1. AMT calculations employed the following formula in which the cascaded area under the system modulation curve is shown in equation (21.104) on page 629 of the "Theory of the Photographic Process", 4th Edition, 1977, edited by T.H. James: AMT=100+66LOG[cascaded area/2.696M] wherein the magnification factor M is 3.8 for the 35mm system AMT. The use of CMT acutance is described by R.G. Gendron in "An Improved Objective Method of Rating Picture Sharpness: CMT Acutance" in the Journal of SMPTE, Vol. 82, pages 1009-12, (1973). AMT is a further modification of CMT useful for evaluating systems which include the viewing of a positive print made from a negative.

Interimage effects (the degree of color correction) was evaluated after a daylight exposure. Interimage, in this case, was quantified as the ratio of the contrast, gamma, of the green-sensitive layer (CAUSER) to that of the red-sensitive layer (RECEIVER), and denoted by ($\gamma/c\gamma r$).

TABLE 1

| Amount to Reduce Gamma Causer ($\gamma_c$) | Interlayer | Acutance |
|---|---|---|

TABLE 1-continued

| Coupler No. | 50% μmoles/m$^2$ | Interimage ($\gamma_c/\gamma_r$) | (35 mm AMT) (Causer) |
|---|---|---|---|
| Con-1 | 48.4 | 1.30 | 91.7 |
| I-1 | 53.8 | 1.34 | 91 |
| I-2 | 96.8 | 1.72 | 93.7 |
| I-3 | 48.4 | 1.58 | 91 |
| I-4 | 102.2 | 1.97 | 93.4 |

Control Coupler, Con-1:

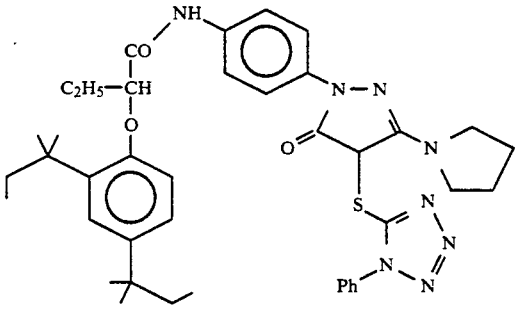

Invention Coupler, I-1:

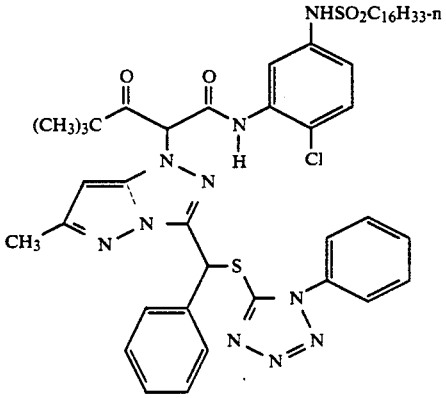

Invention Coupler, I-2:

TABLE 1-continued

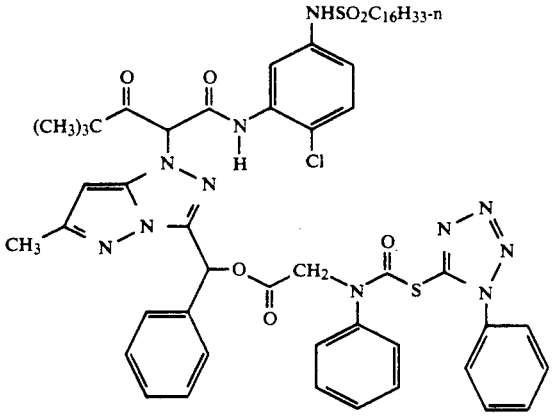

Invention Coupler, I-3:

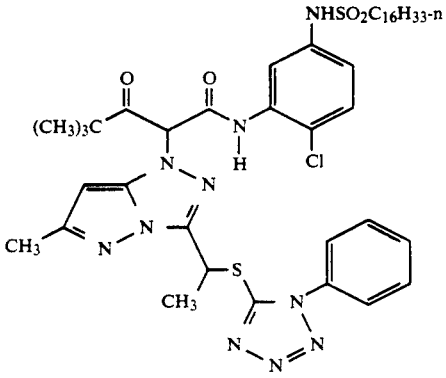

TABLE 1-continued

Invention Coupler, I-4:

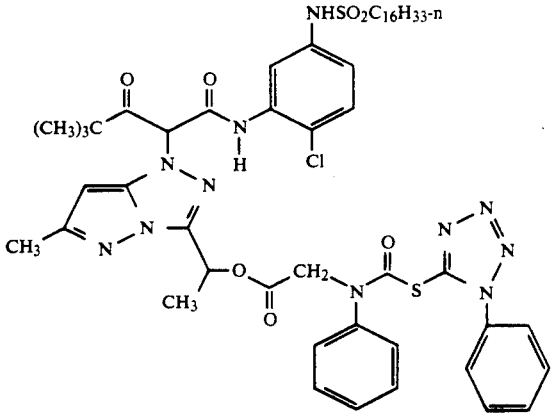

It can be seen from the Interlayer Interimage effects and Causer Acutance values in Table I that the use in photographic silver halide elements of couplers of the invention, I-1, I-2, I-3 and I-4, which contain the described combination of groups, leads to improved sharpness, and interlayer interimage, compared to the Control Coupler, Con-1.

Other preferred examples of preferred coupler (A) are as follows:

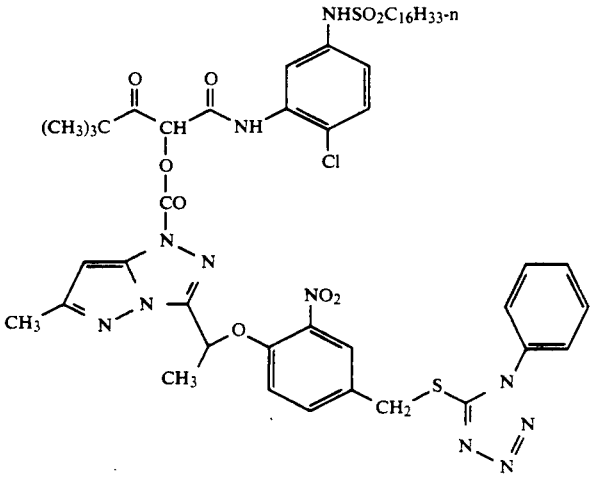

-continued
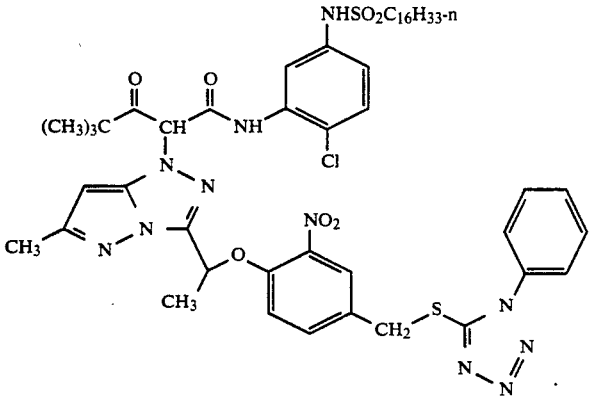
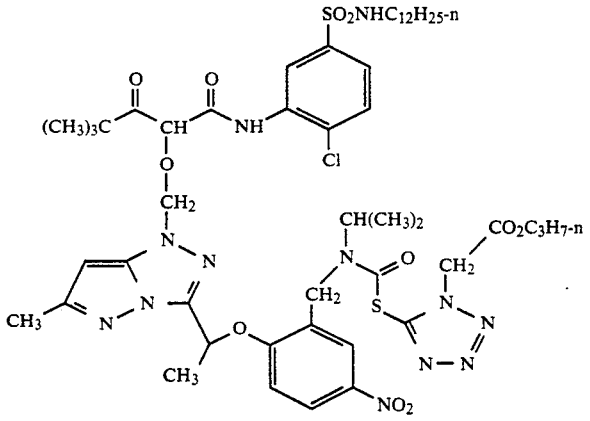
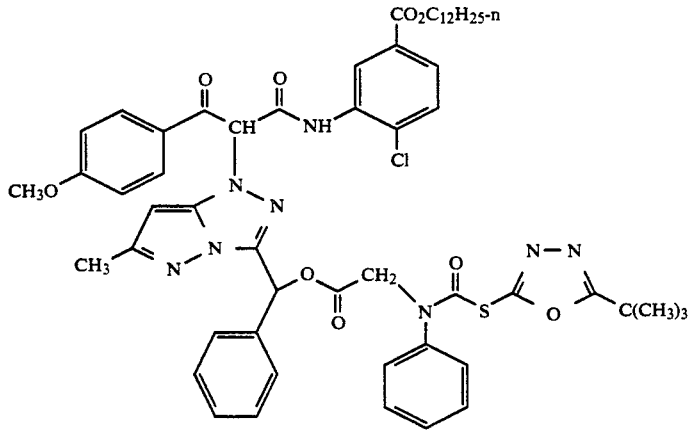

-continued
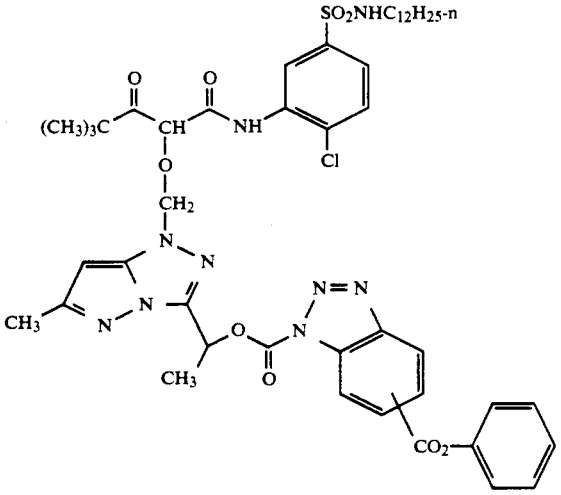
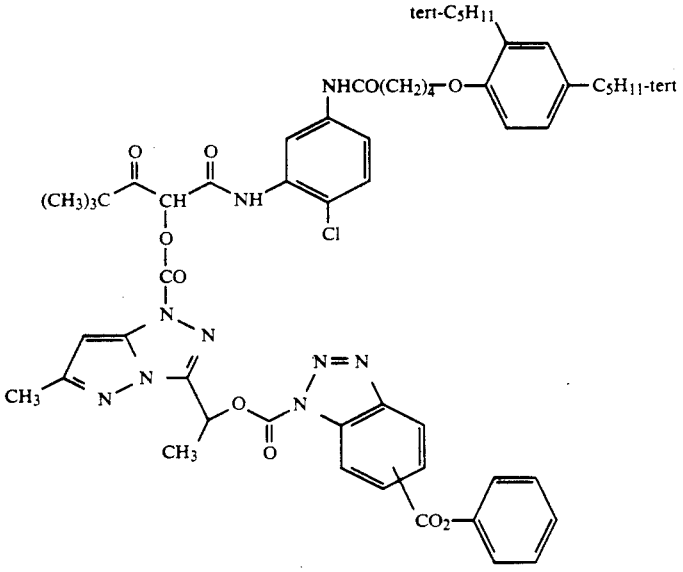
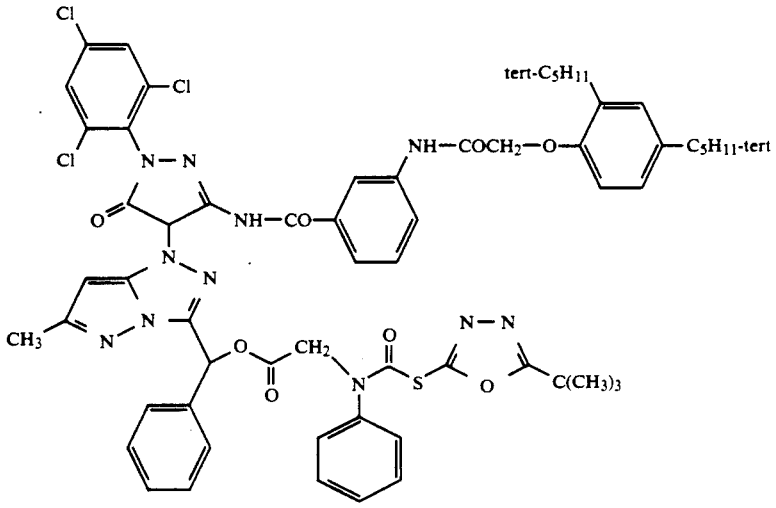

-continued
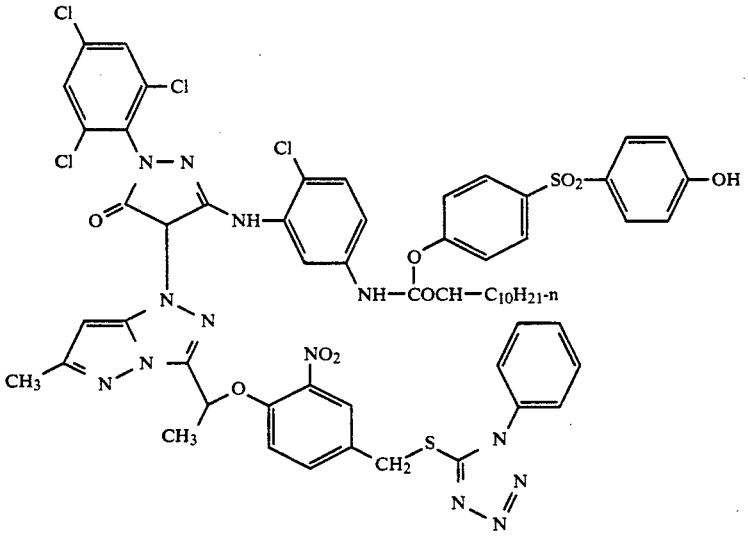
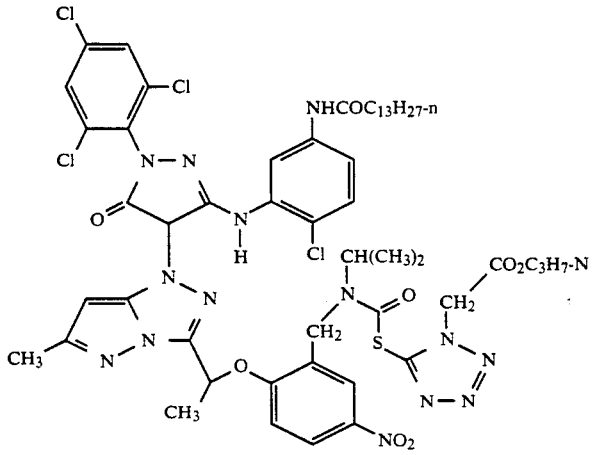
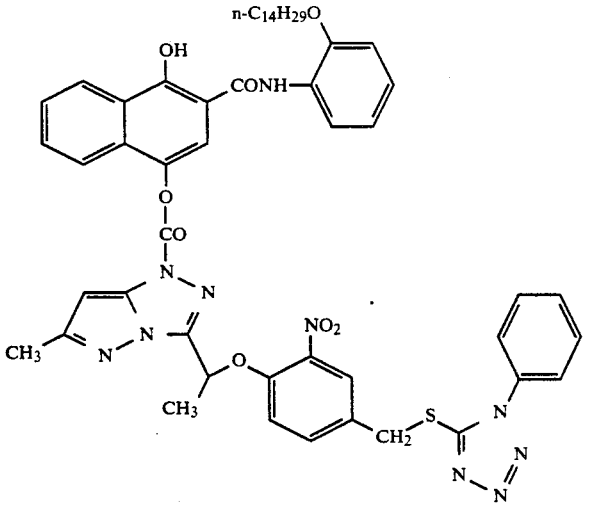

-continued
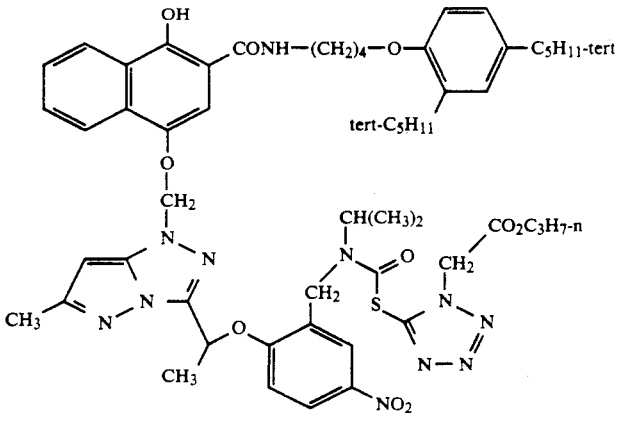
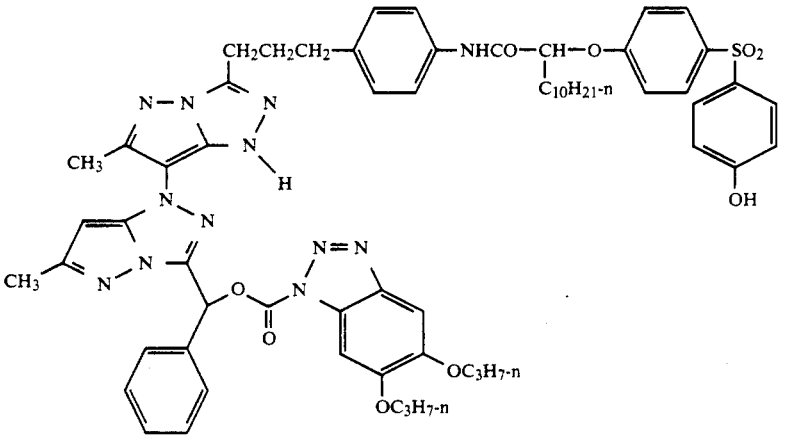
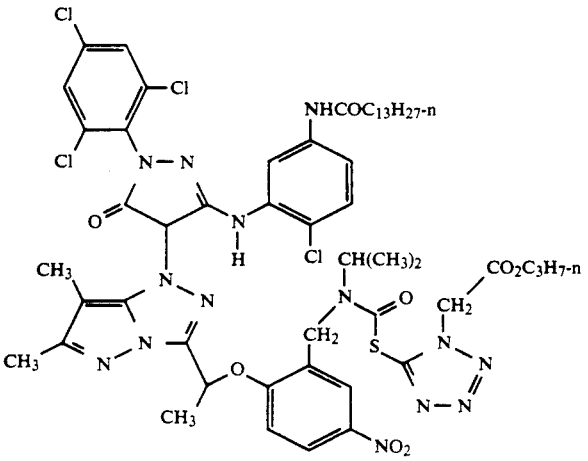

-continued
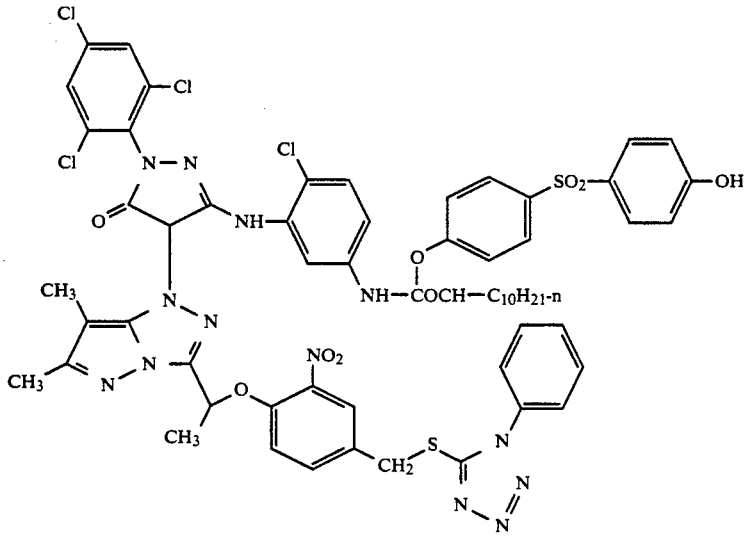
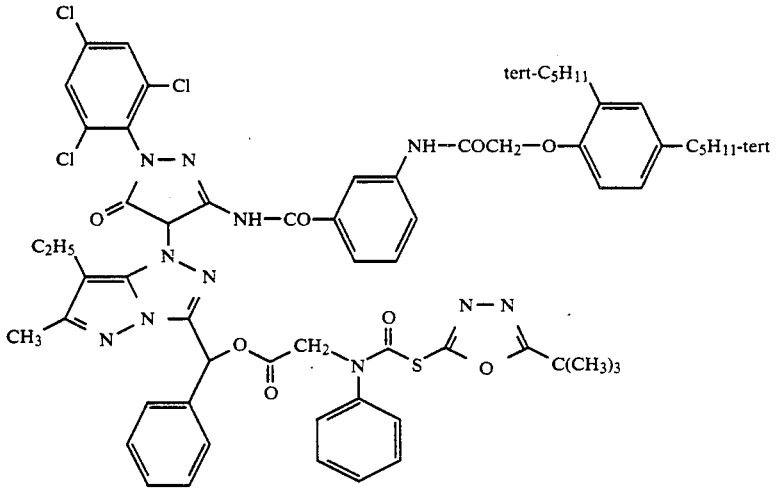
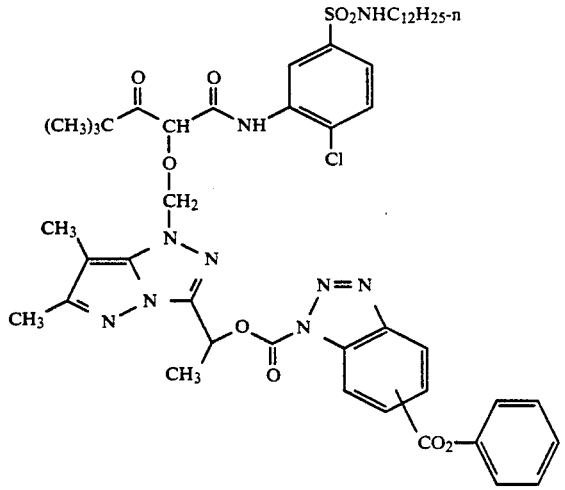

-continued
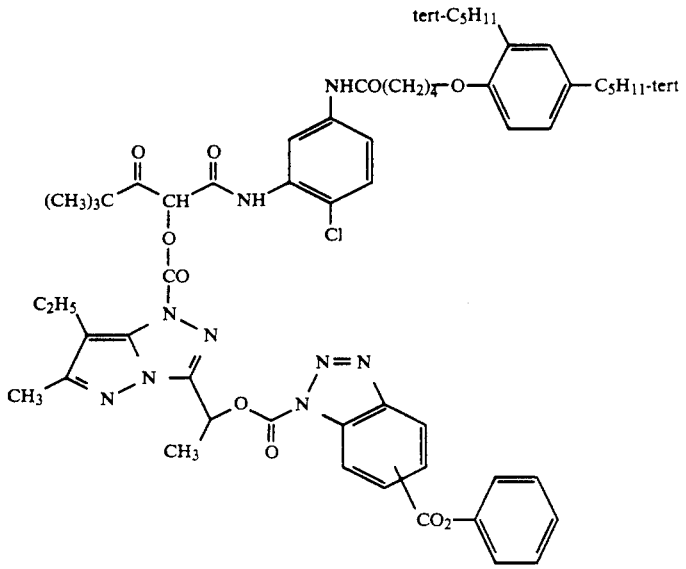
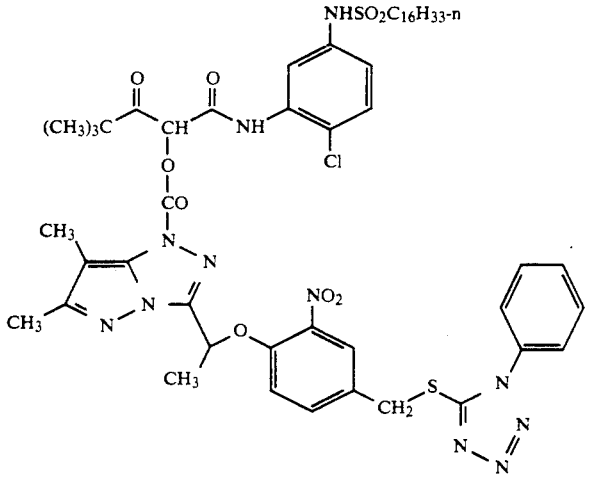
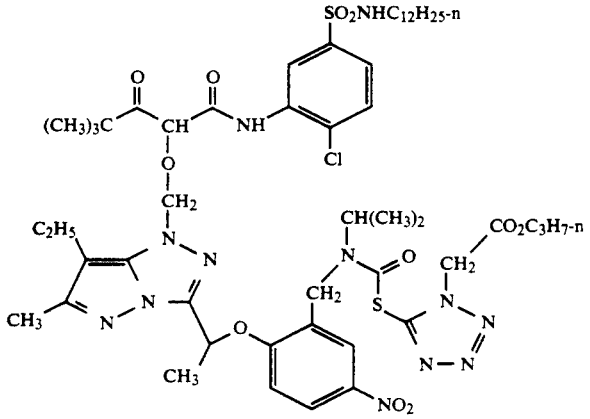

-continued
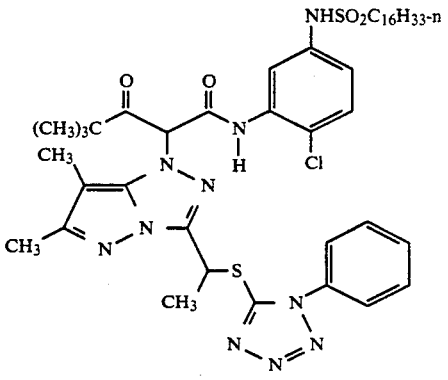
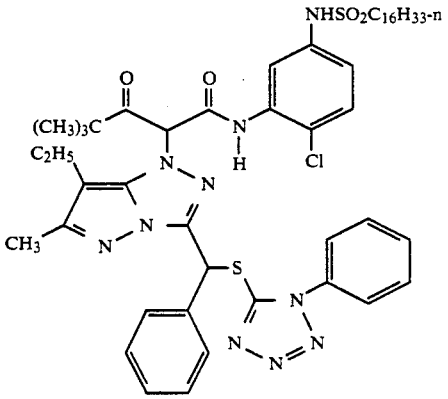
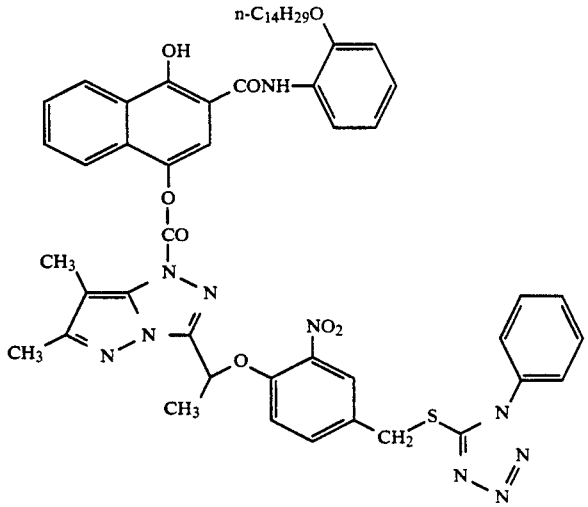

-continued

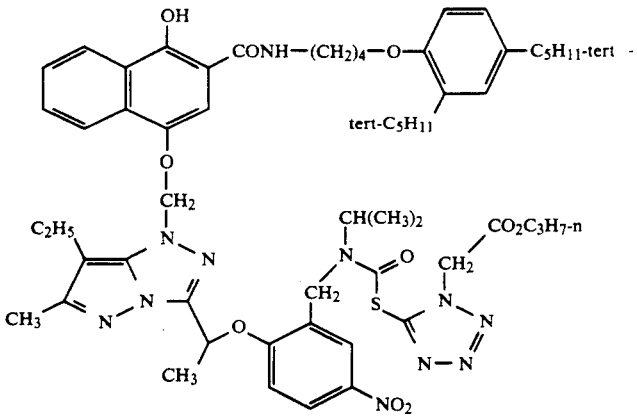

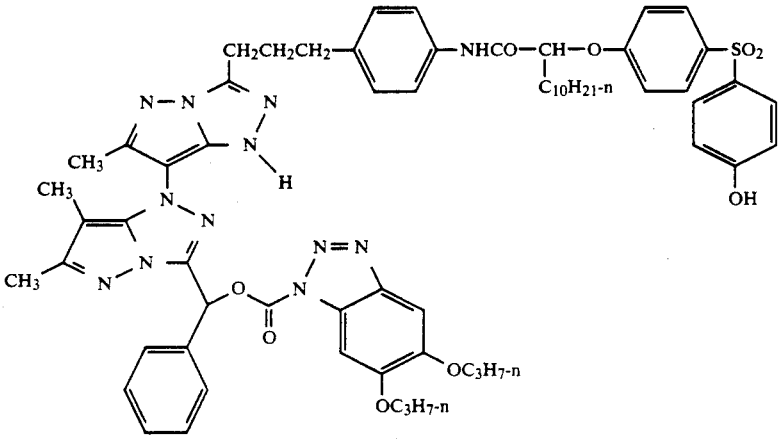

The invention has been described in detail with particular reference to preferred embodiments thereof, but it will be understood that variations and modifications can be effected within the spirit and scope of the invention.

What is claimed is:

1. A photographic element comprising a support bearing at least one photographic silver halide emulsion layer and at least one photographic coupler comprising a pyrazolotriazole moiety (PT), said coupler having the formula

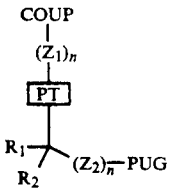

wherein:

COUP is a photographic coupler moiety capable of forming a dye upon reaction with oxidized color developer;

$Z_1$ is a releasing group having an oxygen, nitrogen or sulfur atom bonded to COUP:

$Z_2$ is a timing group containing an oxygen or sulfur atom, said timing group bonded to $—C(R_1)(R_2)—$ by said oxygen or sulfur;

$R_1$ and $R_2$ selected from hydrogen, substituted or unsubstituted aryl, substituted or unsubstituted alkyl, substituted or unsubstituted cycloalkyl, said aryl cycloalkyl or alkyl having substituents selected from ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_1$ and $R_2$;

each n is independently 0 or 1;

PT is a pyrazolotriazole moiety having the structure

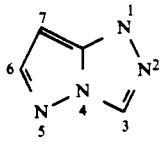

and attached at its 1-position, either directly or through $Z_1$, to the coupling position of COUP, said pyrazolotriazole moiety further having the following group located at its 3-position

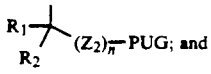

PUG is a photographically useful group which, after reaction of the coupler with oxidized color developer, is capable of being released from the remainder of the coupler.

2. A photographic element comprising a support bearing at least one photographic silver halide emulsion layer and at least one photographic coupler having the formula

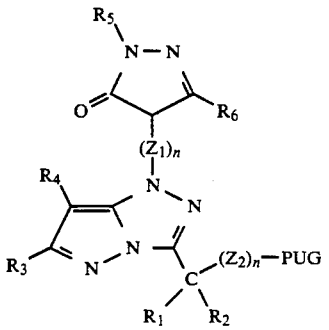

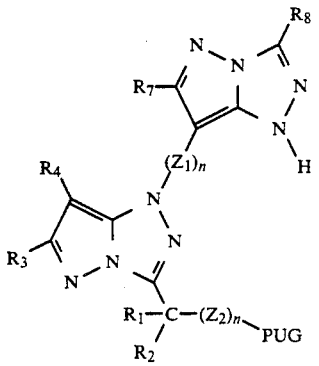

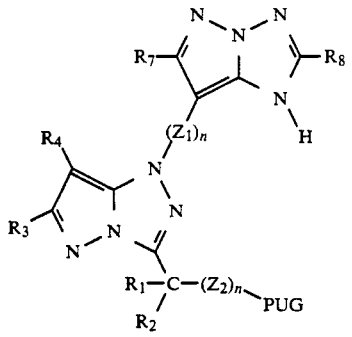

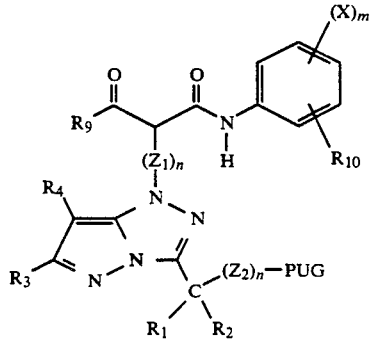

-continued

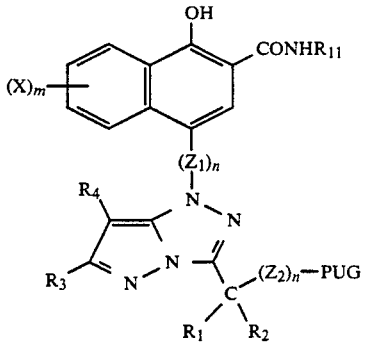

wherein:

n is independently 0 or 1;

$Z_1$ is a releasing group having an oxygen, nitrogen or sulfur atom bonded to COUP:

$Z_2$ is a timing group containing an oxygen or sulfur atom, said timing group bonded to $—C(R_1)(R_2)—$ by said oxygen or sulfur;

$R_1$ and $R_2$ selected from hydrogen, substituted or unsubstituted aryl, substituted or unsubstituted alkyl, substituted or unsubstituted cycloalkyl, said aryl cycloalkyl or alkyl having substituents selected from ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_1$ and $R_2$;

$R_3$ is selected from hydrogen, substituted or unsubstituted aryl, substituted or unsubstituted alkyl, substituted or unsubstituted cycloalkyl wherein said $R_3$ or substituents of said aryl, cycloalkyl and alkyl are selected from ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_3$ and $R_4$;

$R_4$ is selected from hydrogen, substituted or unsubstituted aryl and substituted or unsubstituted alkyl and a group which hinders reaction of oxidized color developer with the pyrazolotriazole moiety;

$R_5$, $R_6$, $R_7$, $R_8$, $R_9$, $R_{10}$ and $R_{11}$ are selected from substituted or unsubstituted alkyl, substituted or unsubstituted aryl, substituted or unsubstituted heterocycles, hydrogen, trifluoromethyl, carbamoyl, carbonamido, sulfamoyl, sulfonamido, cyano, substituted or unsubstituted amino, carboalkoxy, carboaryloxy, alkoxy, aryloxy, thioalkoxy, thioaryloxy, sulfone, and sulfoxide; at least one of $R_5$, $R_6$, $R_7$, $R_8$, $R_9$, $R_{10}$ and $R_{11}$ is a BALLAST;

PUG is a photographically useful group;

m is 0, 1, 2, or 3; and

X is a substituent selected from hydrogen substituted or unsubstituted aryl, substituted or unsubstituted alkyl, ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups.

3. A photographic element comprising a support bearing at least one photographic silver halide emulsion layer and at least one photographic coupler comprising a pyrazolotriazole moiety, said coupler having the formula

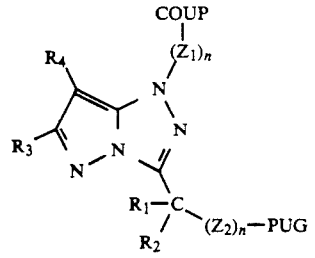

wherein:

each n is independently 0 or 1;

$Z_1$ is a releasing group having an oxygen, nitrogen or sulfur atom bonded to COUP;

$Z_2$ is a timing or releasing group containing an oxygen or sulfur atom, said timing group bonded to —C($R_1$)($R_2$)— by said oxygen or sulfur;

$R_1$ and $R_2$ selected from hydrogen, substituted or unsubstituted aryl, substituted or unsubstituted alkyl, substituted or unsubstituted cycloalkyl, said aryl cycloalkyl or alkyl having substituents selected from ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_1$ and $R_2$;

$R_3$ is selected from hydrogen, substituted or unsubstituted aryl, substituted or unsubstituted alkyl, substituted or unsubstituted cycloalkyl wherein said $R_3$ or substituents of said aryl, cycloalkyl and alkyl are selected from ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_3$ and $R_4$;

$R_4$ is selected from hydrogen, substituted or unsubstituted aryl and substituted or unsubstituted alkyl and a group which hinders reaction of oxidized color developer with the pyrazolotriazole moiety;

PUG is a photographically useful group which is capable of being released from the remainder of the coupler after reaction of the coupler with oxidized color developer; and COUP is a photographic coupler which is attached at its coupling position, either directly or through $Z_1$, to the pyrazolotriazole moiety, and which is capable of forming a dye upon reaction with oxidized color developer.

4. The photographic element in accordance with claim 3 wherein $Z_1$ is selected from oxygen or sulfur containing groups consisting of *—O—C(O)—, *—O—$CH_2$—, *—O—C(S)—, *—S—C(O)—, *—S—C(S)— and *—S—$CH_2$— wherein said group is connected to COUP by the oxygen or sulfur atom denoted by *—O— or *—S—.

5. The photographic element in accordance with claim 3 wherein $Z_2$ is a timing group selected from

*—O—C(O)—

*—O—C(S)—

-continued

*—O—$CH_2$—

*—S—C(O)—

*—S—$CH_2$—

*—S—C(S)—

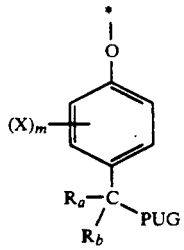

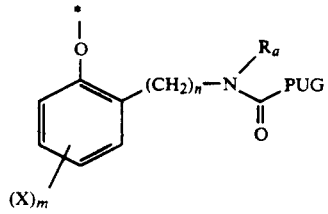

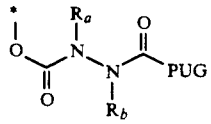

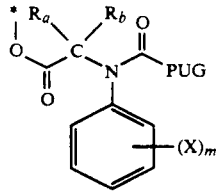

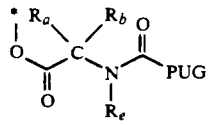

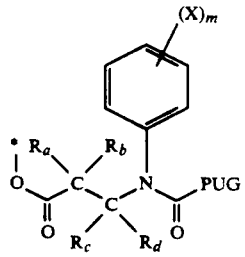

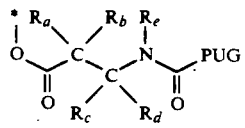

-continued

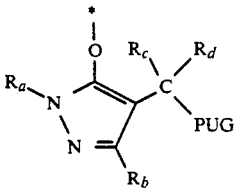

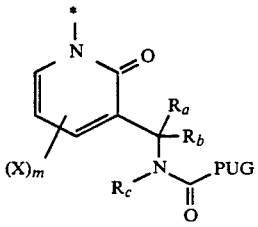

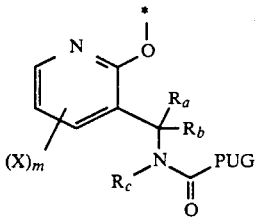

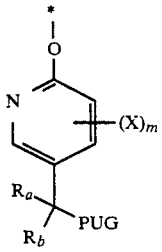

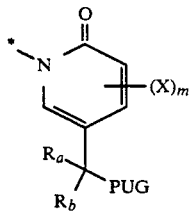

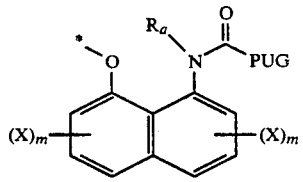

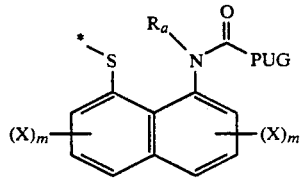

-continued

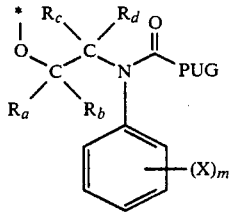

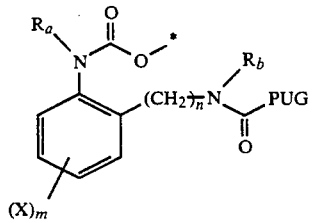

wherein said group is connected to —C($R_1$)($R_2$)— by said oxygen or sulfur atom denoted by *—O— or *—S—;

n is 0 or 1;

m is 0, 1, 2, or 3;

X is a substituent selected from hydrogen, substituted or unsubstituted aryl, substituted or unsubstituted alkyl, ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups; and $R_a$, $R_b$, $R_c$, $R_d$ and $R_e$ are selected from hydrogen, substituted or unsubstituted aryl, and substituted or unsubstituted alkyl.

6. The photographic element in accordance with claim 3 wherein a photographic BALLAST group is attached to COUP.

7. The photographic element in accordance with claim 3 wherein a photographic BALLAST group is attached to $Z_1$.

8. The photographic element in accordance with claim 3 wherein $R_1$, $R_2$, $R_3$ and $R_4$ are selected from hydrogen, methyl, ethyl and phenyl.

9. The photographic element in accordance with claim 3 wherein PUG is selected from development inhibitors, bleach accelerating fragments and dyes.

10. The photographic element in accordance with claim 3 wherein COUP is selected from cyan, magenta, and yellow dye forming couplers.

11. A photographic element comprising a support bearing at least one photographic silver halide emulsion layer and at least one photographic coupler having the formula

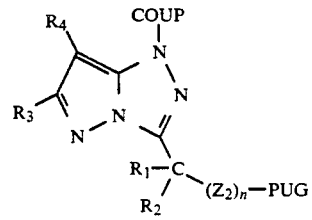

wherein:

n is 0 or 1;

$Z_2$ is a timing or releasing group containing an oxygen or sulfur atom, said timing group bonded to —C($R_1$)($R_2$)— by said oxygen or sulfur;

$R_1$ and $R_2$ selected from hydrogen, substituted or unsubstituted aryl, substituted or unsubstituted alkyl, substituted or unsubstituted cycloalkyl, said aryl cycloalkyl or alkyl having substituents selected from ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_1$ and $R_2$;

$R_3$ is selected from hydrogen, substituted or unsubstituted aryl, substituted or unsubstituted alkyl, substituted or unsubstituted cycloalkyl wherein said $R_3$ or substituents of said aryl, cycloalkyl and alkyl are selected from ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_3$ and $R_4$;

$R_4$ is selected from hydrogen, substituted or unsubstituted aryl and substituted or unsubstituted alkyl and a group which hinders reaction of oxidized color developer with the pyrazolotriazole moiety;

PUG is a photographically useful group which is capable of being released from the remainder of the coupler after reaction of the coupler with oxidized color developer; and COUP is a photographic coupler which is attached at its coupling position, either directly or through $Z_1$, to the pyrazolotriazole moiety, and which is capable of forming a dye upon reaction with oxidized color developer.

12. A photographic element comprising a support bearing at least one photographic silver halide emulsion layer and at least one photographic coupler having the formula

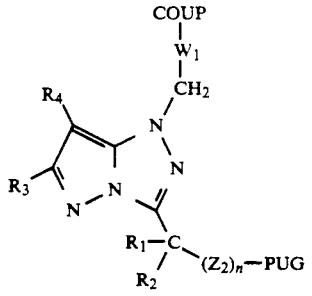

wherein:

n is 0 or 1;

$Z_2$ is a timing or releasing group containing an oxygen or sulfur atom, said timing group bonded to —C($R_1$)($R_2$)— by said oxygen or sulfur;

$R_1$ and $R_2$ selected from hydrogen, substituted or unsubstituted aryl, substituted or unsubstituted alkyl, substituted or unsubstituted cycloalkyl, said aryl cycloalkyl or alkyl having substituents selected from ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_1$ and $R_2$;

$R_3$ is selected from hydrogen, substituted or unsubstituted aryl, substituted or unsubstituted alkyl, substituted or unsubstituted cycloalkyl wherein said $R_3$ or substituents of said aryl, cycloalkyl and alkyl are selected from ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_3$ and $R_4$;

$R_4$ is selected from hydrogen, substituted or unsubstituted aryl and substituted or unsubstituted alkyl and a group which hinders reaction of oxidized color developer with the pyrazolotriazole moiety;

$W_1$ is an oxygen, nitrogen or sulfur atom;

PUG is a photographically useful group which is capable of being released from the remainder of the coupler after reaction of the coupler with oxidized color developer; and COUP is a photographic coupler which is attached at its coupling position, either directly or through $Z_1$, to the pyrazolotriazole moiety, and which is capable of forming a dye upon reaction with oxidized color developer.

13. A photographic element comprising a support bearing at least one photographic silver halide emulsion layer and at least one photographic coupler having the formula

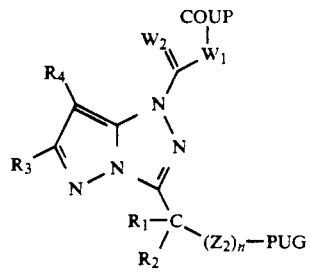

wherein:

n is 0 or 1;

$Z_2$ is a timing or releasing group containing an oxygen or sulfur atom, said timing group bonded to —C($R_1$)($R_2$)— by said oxygen or sulfur;

$R_1$ and $R_2$ selected from hydrogen, substituted or unsubstituted aryl, substituted or unsubstituted alkyl, substituted or unsubstituted cycloalkyl, said aryl cycloalkyl or alkyl having substituents selected from ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_1$ and $R_2$;

$R_3$ is selected from hydrogen, substituted or unsubstituted aryl, substituted or unsubstituted alkyl, substituted or unsubstituted cycloalkyl wherein said $R_3$ or substituents of said aryl, cycloalkyl and alkyl are selected from ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_3$ and $R_4$;

$R_4$ is selected from hydrogen, substituted or unsubstituted aryl and substituted or unsubstituted alkyl and a group which hinders reaction of oxidized color developer with the pyrazolotriazole moiety;

$W_1$ and $W_2$ are selected from an oxygen or sulfur atom;

PUG is a photographically useful group which is capable of being released from the remainder of the coupler after reaction of the coupler with oxidized color developer; and COUP is a photographic coupler which is attached at its coupling position, either directly or through $Z_1$, to the pyrazolotriazole moiety, and which is capable of forming a dye upon reaction with oxidized color developer.

14. A photographic element comprising a support bearing at least one photographic silver halide emulsion layer and at least one photographic coupler having the formula

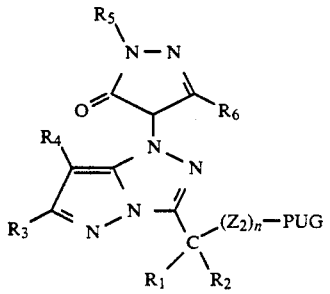

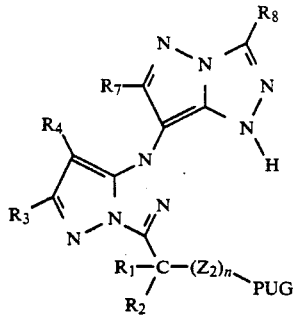

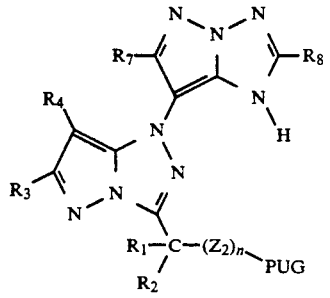

-continued

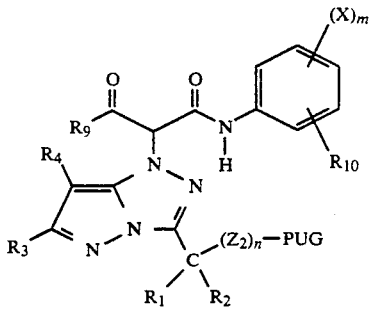

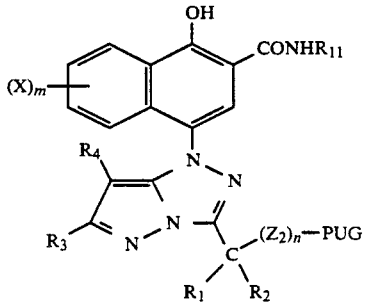

wherein:

n is 0 or 1;

$Z_2$ is a timing or releasing group containing an oxygen or sulfur atom, said timing group bonded to $-C(R_1)(R_2)-$ by said oxygen or sulfur;

$R_1$ and $R_2$ selected from hydrogen, substituted or unsubstituted aryl, substituted or unsubstituted alkyl, substituted or unsubstituted cycloalkyl, said aryl cycloalkyl or alkyl having substituents selected from ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_1$ and $R_2$;

$R_3$ is selected from hydrogen, substituted or unsubstituted aryl, substituted or unsubstituted alkyl, substituted or unsubstituted cycloalkyl wherein said $R_3$ or substituents of said aryl, cycloalkyl and alkyl are selected from ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups, and a 5, 6, or 7-membered ring comprising $R_3$ and $R_4$;

$R_4$ is selected from hydrogen, substituted or unsubstituted aryl and substituted or unsubstituted alkyl and a group which hinders reaction of oxidized color developer with the pyrazolotriazole moiety;

$R_5$, $R_6$, $R_7$, $R_8$, $R_9$, $R_{10}$ and $R_{11}$ are selected from substituted or unsubstituted alkyl, substituted or unsubstituted aryl, substituted or unsubstituted heterocycles, hydrogen, trifluoromethyl, carbamoyl, carbonamido, sulfamoyl, sulfonamido, cyano, substituted or unsubstituted amino, carboalkoxy, carboaryloxy, alkoxy, aryloxy, thioalkoxy, thioaryloxy, sulfone, and sulfoxide; at least one of $R_5$, $R_6$, $R_7$, $R_8$, $R_9$, $R_{10}$ and $R_{11}$ is a BALLAST;

PUG is a photographically useful group;

m is 0, 1, 2, or 3; and

X is a substituent selected from hydrogen substituted or unsubstituted aryl, substituted or unsubstituted alkyl, ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups.

15. The photographic element in accordance with claim 2 wherein $Z_1$ is selected from nitrogen or from oxygen or sulfur containing groups consisting of *—O—C(O)—, *—O—C(S)—, *—O—$CH_2$—, *—S—C(O)—, *—S—C(S)— and *—S—$CH_2$— wherein said group is connected to COUP by the oxygen or sulfur atom denoted by *—O— or *—S—.

16. The photographic element in accordance with claim 14 wherein $Z_2$ is a timing or releasing group selected from

*—O—C(O)—

*—O—C(S)—

*—O—$CH_2$—

*—S—C(O)—

*—S—$CH_2$—

*—S—C(S)—

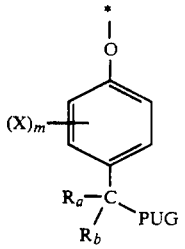

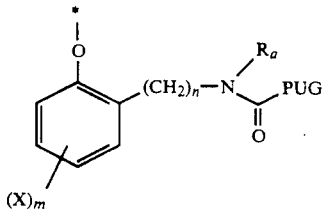

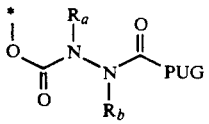

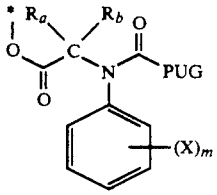

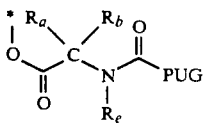

-continued

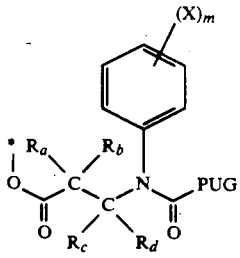

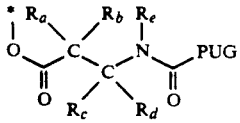

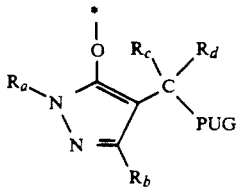

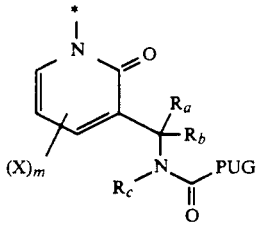

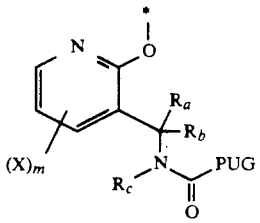

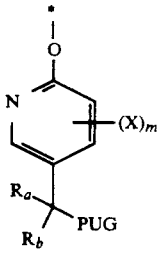

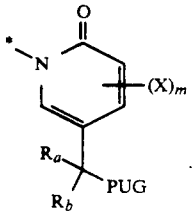

-continued

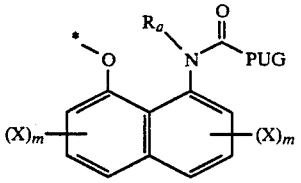

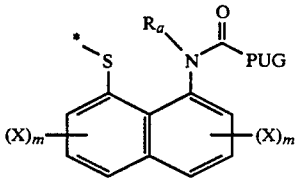

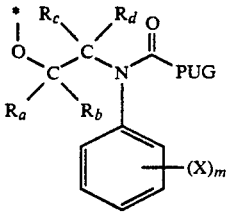

-continued

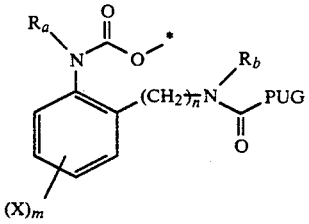

wherein said group is connected to —C($R_1$)($R_2$)— by said oxygen or sulfur atom denoted by *—O— or *—S—;

n is 0 or 1;

m is 0, 1, 2, or 3;

X is a substituent selected from hydrogen substituted or unsubstituted aryl, substituted or unsubstituted alkyl, ester, chloro, bromo, carbamoyl, sulfamoyl, carbonamido, sulfonamido, keto, sulfo, nitro, hydroxyl, carboxyl, amino, substituted amino, alkyl, heterocyclic, alkoxy, aryloxy, arylthio, acylamino groups; and $R_a$, $R_b$, $R_c$, $R_d$ and $R_e$ are selected from hydrogen substituted or unsubstituted aryl, and substituted or unsubstituted alkyl.

* * * * *

UNITED STATES PATENT AND TRADEMARK OFFICE

CERTIFICATE OF CORRECTION

PATENT NO. : 5,306,607

DATED : April 26, 1994

INVENTOR(S) : W. J. Begley et al.

It is certified that error appears in the above-indentified patent and that said Letters Patent is hereby corrected as shown below:

Col 55, line 62, delete ":" and insert --- ; ---.

Col 58, line 19, delete ":" and insert --- ; ---.

Col 58, line 20, after "timing" insert --- or releasing ---.

Col 58, line 26, after "aryl" insert --- , ---.

Col 58, line 59, after "hydrogen" insert --- , ---.

Col 59, line 25, after "aryl" insert --- , ---.

Col 63, line 7, after "aryl" insert --- , ---.

UNITED STATES PATENT AND TRADEMARK OFFICE

CERTIFICATE OF CORRECTION

PATENT NO. : 5,306,607

DATED : April 26, 1994

INVENTOR(S) : W. J. Begley et al.

It is certified that error appears in the above-indentified patent and that said Letters Patent is hereby corrected as shown below:

Col 67, line 1, after "hydrogen" insert --- , ---.

Col 70, line 18, after "hydrogen" insert --- , ---.

Col 70, line 25, after "hydrogen" insert --- , ---.

Signed and Sealed this

Thirteenth Day of September, 1994

*Attest:*

Bruce Lehman

BRUCE LEHMAN

*Attesting Officer*

*Commissioner of Patents and Trademarks*